US008821172B1

(12) United States Patent
Wu et al.

(10) Patent No.: US 8,821,172 B1
(45) Date of Patent: Sep. 2, 2014

(54) ELECTRICAL CONNECTOR AND SOCKET ALLOWING CONNECTOR TO BE ROTATED WHILE PRESERVING POLARITY

(71) Applicant: Google Inc., Mountain View, CA (US)

(72) Inventors: Zhonghua Wu, Fremont, CA (US); Adam Rodriguez, San Francisco, CA (US); Aaron Leiba, San Francisco, CA (US)

(73) Assignee: Google Inc., Mountain View, CA (US)

( * ) Notice: Subject to any disclaimer, the term of this patent is extended or adjusted under 35 U.S.C. 154(b) by 0 days.

(21) Appl. No.: 14/050,035

(22) Filed: Oct. 9, 2013

Related U.S. Application Data

(60) Provisional application No. 61/872,484, filed on Aug. 30, 2013.

(51) Int. Cl.
*H01R 27/00* (2006.01)

(52) U.S. Cl.
USPC ..... 439/218; 439/660

(58) Field of Classification Search
USPC ..... 439/218, 660, 217, 924.1
See application file for complete search history.

(56) References Cited

U.S. PATENT DOCUMENTS

| | | | | |
|---|---|---|---|---|
| 4,993,975 | A | 2/1991 | Asick et al. | |
| 5,278,725 | A | 1/1994 | Konno et al. | |
| 5,751,544 | A | 5/1998 | Song | |
| 5,771,540 | A | 6/1998 | Carpenter et al. | |
| 6,431,887 | B1 | 8/2002 | Yeomans et al. | |
| 6,481,057 | B2 | 11/2002 | Lin | |
| 7,055,215 | B1 | 6/2006 | Ligtenberg et al. | |
| 7,361,059 | B2 * | 4/2008 | Harkabi et al. | 439/660 |
| 7,363,947 | B2 * | 4/2008 | Teicher | 139/173 |
| 7,387,539 | B2 * | 6/2008 | Trenne | 439/660 |
| 7,500,861 | B2 * | 3/2009 | Harkabi et al. | 439/218 |
| 7,572,153 | B2 * | 8/2009 | Trenne | 439/660 |

(Continued)

FOREIGN PATENT DOCUMENTS

| | | | |
|---|---|---|---|
| EP | 1670101 | A1 | 6/2006 |
| EP | 1933259 | A1 | 6/2008 |
| WO | 2011/150403 | A1 | 12/2011 |

OTHER PUBLICATIONS

"Apple is Granted 6 MacBook Pro Design Patents in Hong Kong", Patently Apple, retrieved on Apr. 16, 2013 from www.patentlapple.com/patently-apple/2013/04/apple-is-granted-6-macbook-pro-design-patents-in-hong-kong.htm, 9 pages.

(Continued)

*Primary Examiner* — Gary Paumen
(74) *Attorney, Agent, or Firm* — Brake Hughes Bellermann LLP

(57) ABSTRACT

An electrical connector may include a cord comprising a plurality of wires and a plug extending from the cord. The plug may include a top portion and an opposing bottom portion, which each include a plurality of contacts. The plurality of contacts on each of the top portion and opposing bottom portion may include at least two contacts with a first distance from a front portion of the plug and at least one contact with a second distance from the front of the plug. Each of the plurality of contacts on the top portion may be coupled to one of the plurality of wires and to one of the plurality of contacts on the bottom portion. The coupling may be configured to maintain a same arrangement of contacts and electrical paths to the plurality of wires when the plug is rotated one hundred eighty degrees.

17 Claims, 14 Drawing Sheets

(56) References Cited

U.S. PATENT DOCUMENTS

| | | | | |
|---|---|---|---|---|
| 7,591,657 | B2 * | 9/2009 | Teicher | 439/173 |
| 7,597,591 | B2 * | 10/2009 | Leubner | 439/676 |
| 7,984,532 | B2 | 7/2011 | Huang | |
| 8,091,178 | B2 | 1/2012 | Degner et al. | |
| 8,251,723 | B2 * | 8/2012 | Tsai | 439/218 |
| 2006/0024997 | A1 | 2/2006 | Teicher | |
| 2006/0065681 | A1 | 3/2006 | Yeh et al. | |
| 2007/0186382 | A1 | 8/2007 | Huang | |
| 2011/0039435 | A1 * | 2/2011 | Huang | 439/218 |
| 2012/0015561 | A1 | 1/2012 | Tsai | |
| 2012/0289073 | A1 * | 11/2012 | Wu et al. | 439/218 |
| 2013/0115821 | A1 | 5/2013 | Golko et al. | |

OTHER PUBLICATIONS

"MacBook Pro (Retina, 15-inch, Early 2013)—Technical Specifications", Mar. 19, 2013, 4 pages.
Schock, "How to Fix a Wobbly Macbook Pro Screen", retrieved from schock.net/articles/2012/02/20/how-to-fix-a-wobbly-macbook-pro-screen/, Feb. 20, 2012, 4 pages.
"Apple Connector", May 15, 2013, 1 page.
"Apple Lightning", May 15, 2013, 1 page
"Micro Usb Plug", May 15, 2013, 1 page.
International Search Report and Written Opinion for International Application No. PCT/US2014/010050, mailed Mar. 28, 2014, 15 pages.

* cited by examiner

ELECTRICAL CONNECTOR AND SOCKET ALLOWING CONNECTOR TO BE ROTATED WHILE PRESERVING POLARITY

CROSS-REFERENCE TO RELATED APPLICATION

This Application claims the benefit of U.S. Provisional Application No. 61/872,484, filed on Aug. 30, 2013, entitled, "Electrical Connector and Socket Allowing Connector To Be Rotated While Preserving Polarity," the disclosure of which is incorporated by reference.

TECHNICAL FIELD

This description relates to electrical connectors and sockets.

BACKGROUND

Electrical connectors and/or sockets transmit data and/or power between electrical devices. It may be difficult to achieve desired size and/or space constraints while maintaining capability to transmit the required data and/or power.

SUMMARY

According to an example implementation, an electrical connector may include a cord comprising a plurality of wires and a plug extending from the cord. The plug may include a top portion and an opposing bottom portion, which each include a plurality of contacts. The plurality of contacts on each of the top portion and opposing bottom portion may include at least two contacts with a first distance from a front portion of the plug and at least one contact with a second distance from the front of the plug. Each of the plurality of contacts on the top portion may be coupled to one of the plurality of wires and to one of the plurality of contacts on the bottom portion. The coupling may be configured to maintain a same arrangement of contacts and electrical paths to the plurality of wires when the plug is rotated one hundred eighty degrees.

According to another example implementation, an electrical connector may include a cord including a plurality of wires and a plug extending from the cord. The plug may include a top portion and an opposing bottom portion. Each of the top portion and opposing bottom portion may include a plurality of electrical contacts arranged in a plurality of columns, the columns on the top portion being ordered sequentially from a first side portion to a second side portion and the columns on the opposing bottom portion being ordered sequentially from the second side portion to the first side portion. Each of the plurality of columns may include either one or two of the electrical contacts, the columns that include two electrical contacts having the two electrical contacts arranged longitudinally with respect to each other along an imaginary line in a direction in which the plug extends from the cord with a first of the two electrical contacts closer to a front portion of the plug and a second of the two electrical contacts farther from the front portion of the plug. The electrical contacts included in a column that includes only one electrical contact may coupled to one of the plurality of wires and one of the electrical contacts in a column with a same ordinal number on the opposing top or bottom portion. The electrical contacts included in a column that includes two electrical contacts may be coupled to one of the plurality of wires and one of the electrical contacts in a column with a same ordinal number on the opposing top or bottom portion. If the electrical contact is the first contact closer to the front portion, the electrical contact may be coupled to the first electrical contact closer to the front portion of the plug in the column with the same ordinal number. If the electrical contact is the second contact farther from the front portion, the electrical contact may be coupled to the second electrical contact farther from the front portion of the plug in the column with the same ordinal number.

According to another example implementation, an electrical socket may include a housing defining a recess and an opening of the socket and a plurality of pins extending into the recess. Each of the plurality of pins may terminate at either a first distance from the opening, a second distance from the opening, or a third distance from the opening. The pins that terminate the first distance from the opening may be coupled to one other pin of the plurality of pins. The pins that terminate the second distance from the opening may not be coupled to any other of the plurality of pins. The pins that terminate the third distance from the opening may not be coupled to any other of the plurality of pins.

According to another example implementation, an electrical socket may include a first side portion, a top portion adjacent to the first side portion, a second side portion adjacent to the top portion and opposite from the first side portion, and a bottom portion adjacent to the first side portion and the second side portion and opposite from the top portion, the first side portion, top portion, second side portion, and a bottom portion defining a recess of the electrical socket. The electrical socket may also include at least a first electrical node, a second electrical node, a third electrical node, and a fourth electrical node. The electrical socket may also include a least a first pin extending into the recess from the top portion, a second pin extending into the recess from the top portion, a third pin extending into the recess from the top portion, a fourth pin extending into the recess from the bottom portion, a fifth pin extending into the recess from the bottom portion, and a sixth pin extending into the recess from the bottom portion. The first pin may be coupled to the first electrical node and is closer to the first side portion than the second pin and the third pin, the second pin may be coupled to the second electrical node and is farther from the first side portion than the first pin, farther from a front of the socket than the fifth pin, and farther from the second side portion than the third pin, the third pin may be coupled to the third electrical node and is closer to the second side portion than the first pin and the second pin, the fourth pin may be coupled to the first electrical node and is closer to the second side portion than the fifth pin and the sixth pin, the fifth pin may be coupled to the fourth electrical node and is farther from the second side portion than the fourth pin, closer to the front of the socket than the second pin, and farther from the first side portion than the sixth pin, and the sixth pin may be coupled to the third electrical node and is closer to the first side portion than the fifth pin and the sixth pin.

According to another example implementation, an electrical socket may include a top portion and a bottom portion above and below a recess of the electrical socket, at least a first electrical node, a second electrical node, a third electrical node, and a fourth electrical node. The electrical socket may also include a least a first pin extending into the recess from the top portion, a second pin extending into the recess from the top portion, a third pin extending into the recess from the top portion, a fourth pin extending into the recess from the bottom portion, a fifth pin extending into the recess from the bottom portion, and a sixth pin extending into the recess from the bottom portion. The first pin may be coupled to the first electrical node, the second pin may be coupled to the second electrical node and is farther from a front of the socket than the fifth pin, the third pin may be coupled to the third electrical node, the fourth pin may be coupled to the first electrical node, the fifth pin may be coupled to the fourth electrical node and is closer to the front of the socket than the second pin, and the sixth pin may be coupled to the third electrical node.

The details of one or more implementations are set forth in the accompanying drawings and the description below. Other features will be apparent from the description and drawings, and from the claims.

DETAILED DESCRIPTION

Figure 1A:
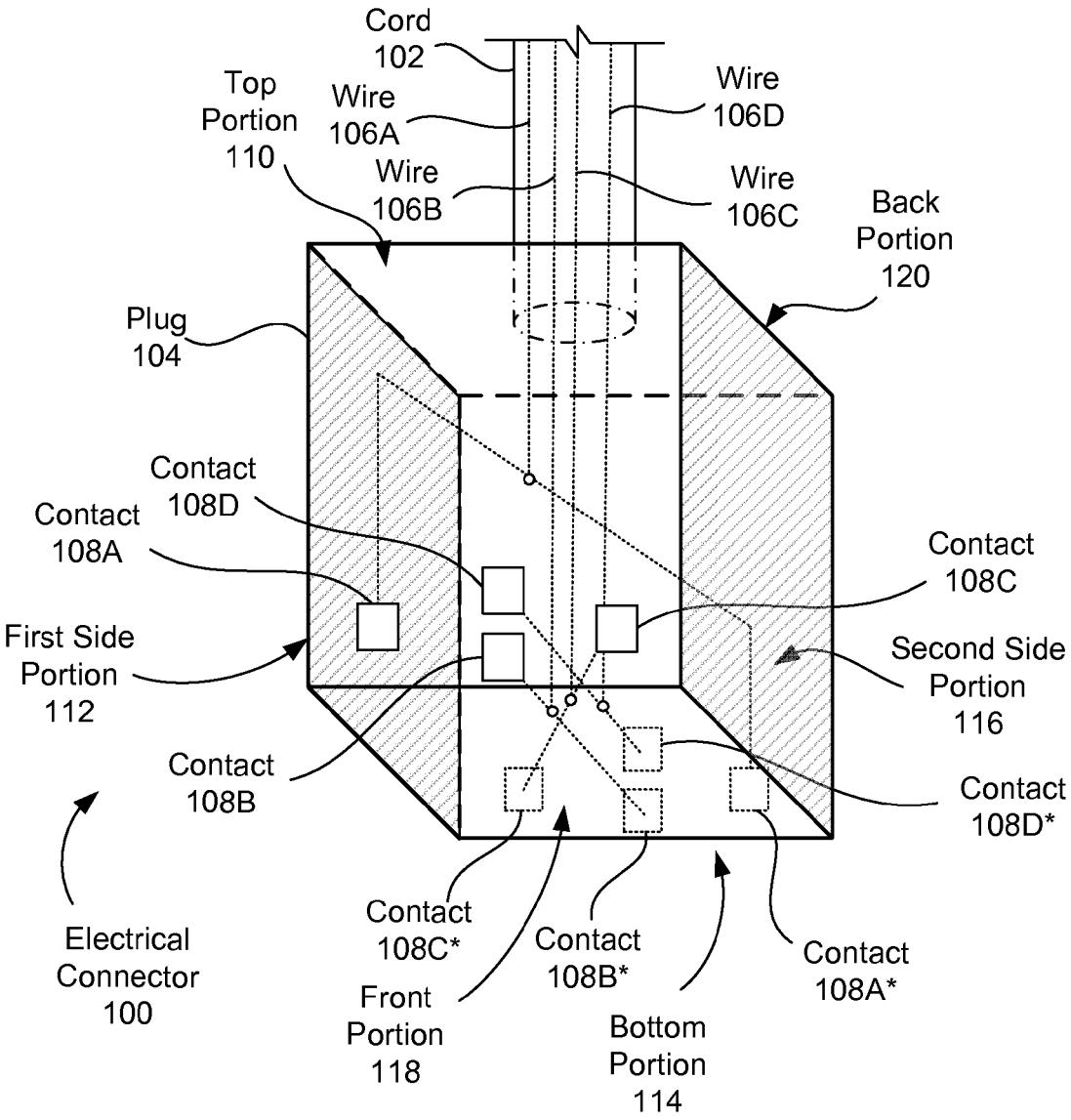
FIG. 1A is a perspective view of an electrical connector according to an example embodiment.

Users of electrical devices, such as computing devices, may insert an electrical connector into a socket. The electrical connector may be connected and/or coupled to a first electrical device, such as a first computing device, and the user may insert the electrical connector into the socket of a second electrical device, such as a second computing device. The user may rotate the electrical connector one hundred eighty degrees. According to example embodiments described herein, the connector and socket may maintain the same functionality when the electrical connector is rotated by mirroring the electrical contacts or pads on the electrical connector, and/or by mirroring the pins on the socket (also can be referred to as a receptacle) that engage (e.g., receive) and/or couple with the electrical contacts or pads. Some embodiments described herein may reduce a width of the connector and/or socket by including multiple contacts in a y-axis or column. As used herein, electrical contacts or pads on the electrical connector will be referred to as "contacts."

The electrical connector may have contacts on both a top and bottom of a plug, and the socket may have pins on both a top and bottom of the socket. To reduce a width of the electrical connector, some of the contacts may be arranged longitudinally with respect to each other in columns. Some of the columns may include two contacts arranged longitudinally with respect to each other, whereas other columns may include only one contact.

It may be difficult to design a socket with two or more pins arranged longitudinally with respect to each other. The socket may include only one pin per column of the electrical connector. The pins corresponding to the electrical connector columns with two contacts may have different distances from an opening of the socket on the top of the socket, than on the bottom of the socket. The different distances from the opening of the pins on the top and bottom of the socket, and the coupling of the contacts with each other, may allow the respective pins on the top and bottom of the socket to engage the same nodes regardless of the orientation of the electrical connector, as described below.

According to example couplings described below, each of a plurality of nodes in the socket may be coupled to either one or two pins in the socket. When the plug of the electrical connector is inserted into the socket, a node coupled to only one pin may couple to one of two coupled contacts on the plug via the one pin. The one contact to which the node couples may be included in a column with two contacts. The nodes coupled to the one of two coupled contacts in columns with two contacts may require only a single path for their data or power requirements.

A node coupled to two pins may couple to two coupled contacts on the plug via the two pins. The two coupled contacts on the plug may be on opposite sides (top and bottom) of the plug, and each of the two coupled contacts may be included in a column with only one contact. The nodes coupled to the two coupled contacts included in columns with only one contact may require two paths for their data or power requirements.

FIG. 1A is a perspective view of an electrical connector 100 according to an example embodiment. The electrical connector 100 may include a cord 102 and a plug 104. The cord 102 may couple to another electrical device or computing device, and the plug 104 may be inserted into, received by, and/or couple with the socket(s) described herein. The plug 104 may include a printed circuit board (PCB). The plug 104 may transmit and/or receive data according to a universal serial bus (USB) protocol or other communication protocol.

The plug 104 may include a top portion 110, a first side portion 112 adjacent to the top portion 110, a bottom portion 114 adjacent to the first side portion 112 and opposite from the top portion 110, and a second side portion 116 adjacent to the top portion 110 and bottom portion 114 and opposite from the first side portion 112. The top portion 110, first side portion 112, bottom portion 114, and second side portion 116 may all be rectangular, or may be any other shape. The top portion 110 and bottom portion 114 may have same dimensions, such as a same length and a same width. The first side portion 112 and second side portion 116 may also have same dimensions, such as a same length and a same width. However, the first and second side portions 112, 116 may have different dimensions, such as different lengths and/or widths, than the top and bottom portions 110, 114, allowing the user to rotate the plug 104 one hundred eighty degrees and insert the plug 104 into the socket, while preventing the user from rotating the plug 104 ninety degrees and inserting the plug 104 into the socket.

The plug 104 may also include a back portion 120. The back portion 120 may be adjacent to the top portion 110, first side portion 112, bottom portion 114, and second side portion 116, and may receive the cord 102. The plug 104 may also include a front portion 118. The front portion 118 may be adjacent to the top portion 110, first side portion 112, bottom portion 114, and second side portion 116, and may be on an opposite side of the plug 104 from the cord 102. The front and back portions 118, 120 may be rectangular, and may have similar dimensions, such as a same length and width.

The cord 102 may include and/or insulate a plurality of wires. As used herein, the term "wire" may include any guided medium for carrying electrical power and/or signals, such as a metal wire or a fiber optic cable. In the example shown in FIG. 1A, the cord 102 includes four wires, a first wire 106A, a second wire 106B, a third wire 106C, and a fourth wire 106D. However, the cord 102 may include any number of wires.

The plug 104 may include a plurality of contacts on, extending from, and/or recessed within, the top portion 110, and a plurality of contacts on, extending from, and/or recessed within, the bottom portion 114. In the example shown in FIG. 1A, the top portion 110 of the plug 104 includes four contacts, a first contact 108A, a second contact 108B, a third contact 108C, and a fourth contact 108D, and the bottom portion 114 includes four contacts, a fifth contact 108A*, a sixth contact 108B*, a seventh contact 108C*, and an eighth contact 108D*. However, the plug 104 may include any number of contacts. The plug 104 may include, for example, a number of contacts on the top portion 110 equal to the number of wires included in the cord 102, and a number of contacts on the bottom portion 114 equal to the number of wires included in the cord 102, for a total of two contacts on the plug 104 for each wire included in the cord 102. The cord 102 may also include wires not coupled to any of the contacts, and the plug 104 may also include contacts not coupled to any of the wires.

The wires included in the cord 102 may each be coupled to one, and only one, of the contacts on the top portion 110 of the plug 104. The wires included in the cord 102 may also each be coupled to one, and only one, of the contacts on the bottom portion 114 of the plug 104. In the example shown in FIG. 1A, the first wire 106A is coupled to the first contact 108A on the top portion 110 of the plug 104 and fifth contact 108A* on the bottom portion 114 of the plug 104, the second wire 106B is coupled to the second contact 108B on the top portion 110 of the plug 104 and sixth contact 108B* on the bottom portion 114 of the plug 104, the third wire 106C is coupled to the third contact 108C on the top portion 110 of the plug 104 and seventh contact 108C* on the bottom portion 114 of the plug 104, and the fourth wire 106D on the top portion 110 of the plug 104 is coupled to the fourth contact 108D and eighth contact 108D* on the bottom portion 114 of the plug 104.

Figure 1B:
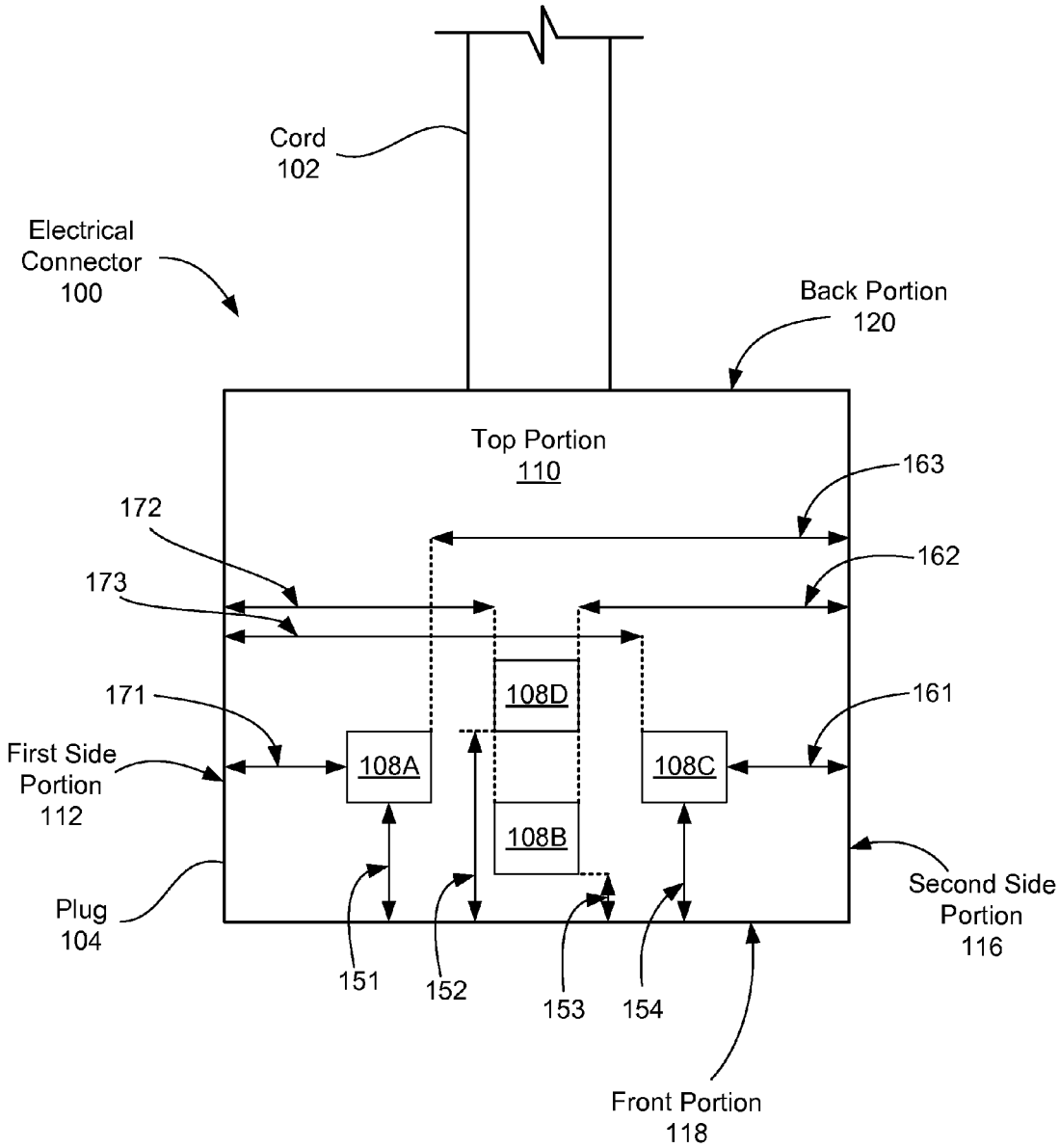
FIG. 1B is a top view of the electrical connector of FIG. 1A according to an example embodiment.

FIG. 1B is a top view of the electrical connector 100 of FIG. 1A according to an example embodiment. This view shows relationships or distances between the contacts 108A, 108B, 108C, 108D on the top portion 110 with respect to the first side portion 112, front portion 118, and second side portion 116 of the plug 104. The distances shown in FIG. 1B are based on a closest portion of the contacts 108A, 108B, 108C, 108D to the respective first side portion 112, front portion 118, or second side portion 116; however, the distances may be measured from any portion of the contacts 108A, 108B, 108C, 108D, such as an interior or middle portion or farthest portion.

The first contact 108A may have a distance 171 from the first side portion 112 that is smaller and/or closer than the distances 172, 173 of the second, third, and fourth contacts 108B, 108C, 108D. The first contact 108A may also have a distance 151 that is the same or less/closer than a distance 152 between the fourth contact 108D from the front portion 118, the same or greater/farther than a distance 153 between the second contact 108B and the front portion 118, and/or the same as a distance 154 between the third contact 108C and the front portion.

The second contact 108B may have a distance 153 from the front portion 118 that is less and/or closer than the distance 152 between the fourth contact 108D and the front portion 118. The distance 153 between the second contact 108B and the front portion 118 may be the same or less/closer than the distances 151, 154 between the first and third contacts 108A, 108C and the front portion 118. In the example shown in FIG. 1B, the distance 172 between the second contact 108B and the first side portion 112 is greater and/or farther than the distance 171 between the first contact 108A and the first side portion 112, and the distance 162 between the second contact 108B and the second side portion 116 is greater and/or farther than the distance 161 between the third contact 108C and the second side portion 116. However, while FIG. 1B shows the second and fourth contacts 108B, 108D, which are arranged longitudinally with respect to each other in a column, between the first and third contact 108A, 108C and/or in an interior position on the top portion 110, the contacts that are arranged longitudinally with respect to each other in a column may also be located on exterior positions on the top portion 110, closer to side portions 112, 116 than contacts that are included in columns with only a single contact.

The third contact 108C may have a distance 161 from the second side portion 116 that is smaller and/or closer than the distances 162, 163 between the first, second, and fourth contacts 108A, 108B, 108D and the second side portion 116. The third contact 108C may have a distance 154 from the front portion 118 that is the same or greater/farther than the distance 153 between the second contact 108B and the front portion 118, the same as the distance 151 between the first contact 108A and front portion 118, and/or the same or less/closer than the distance 152 between the fourth contact 108D and front portion 118.

Figure 1C:
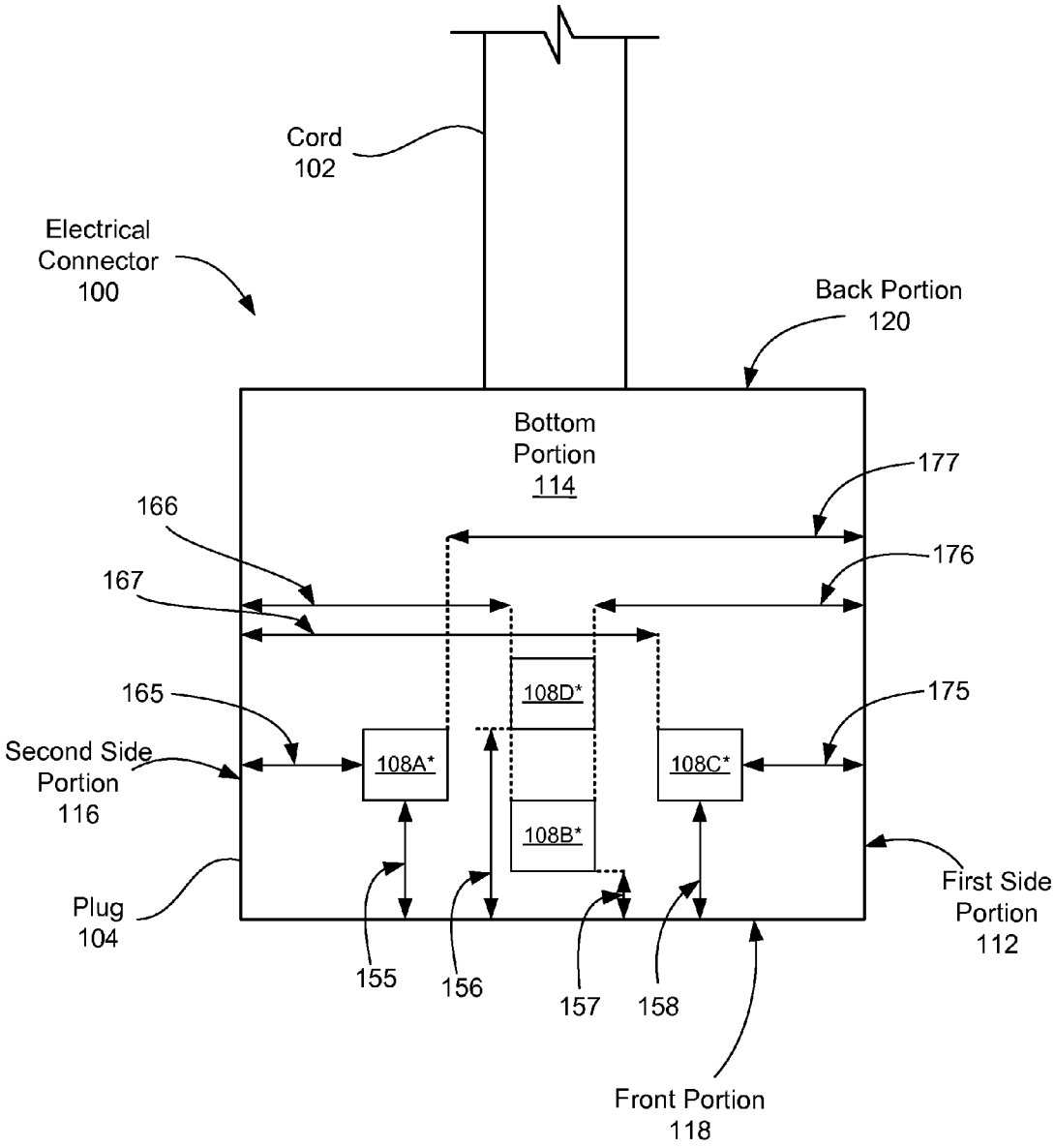
FIG. 1C is a bottom view of the electrical connector of FIG. 1A according to an example embodiment.

FIG. 1C is a bottom view of the electrical connector 100 of FIG. 1A according to an example embodiment. The contacts 108A*, 108B*, 108C*, 108D* on the bottom portion 114 may have similar spatial arrangements as the contacts 108A, 108B, 108C, 108D on the top portion 110.

The fifth contact 108A* may have a distance 165 from the second side portion 116 that is smaller and/or closer than the distances 166, 167 of the sixth, seventh, and eighth contacts 108B*, 108C*, 108D*. The fifth contact 108A* may also have a distance 155 that is the same or less/closer than a distance 156 between the eighth contact 108D* from the front portion 118, the same or greater/farther than a distance 157 between the sixth contact 108B* and the front portion 118, and/or the same as a distance 158 between the seventh contact 108C* and the front portion 118.

The sixth contact 108B* may have a distance 157 from the front portion 118 that is less and/or closer than the distance 156 between the eighth contact 108D* and the front portion 118. The distance 157 between the sixth contact 108B* and the front portion 118 may be the same or less/closer than the distances 155, 158 between the fifth and seventh contacts 108A*, 108C* and the front portion 118. In the example shown in FIG. 1B, the distance 166 between the sixth contact 108B* and the second side portion 116 is greater and/or farther than the distance 165 between the fifth contact 108A* and the second side portion 116, and the distance 176 between the sixth contact 108B* and the first side portion 112 is greater and/or farther than the distance 175 between the seventh contact 108C* and the first side portion 112. However, while FIG. 1B shows the sixth and eighth contacts 108B*, 108D*, which are arranged longitudinally with respect to each other in a column, between the fifth and seventh contact 108A*, 108C* and/or in an interior position on the top portion 110, the contacts that are arranged longitudinally with respect to each other in a column may also be located on exterior positions on the top portion 110, closer to side portions 112, 116 than contacts that are included in columns with only a single contact.

The seventh contact 108C* may have a distance 175 from the first side portion 112 that is smaller and/or closer than the distances 176, 177 between the fifth, sixth, and eighth contacts 108A*, 108B*, 108D* and the first side portion 112. The seventh contact 108C* may have a distance 158 from the front portion 118 that is the same or greater/farther than the distance 157 between the sixth contact 108B*, the same as the distance 155 between the fifth contact 108A* and front portion 118, and/or the same or less/closer than the distance 156 between the eighth contact 108D* and front portion 118.

According to an example embodiment, the plurality of contacts 108A, 108B, 108C, 108D, 108A*, 108B*, 108C*, 108D* on each of the top portion 110 and opposing bottom portion 114 may include contacts 108A, 108B, 108C, 108D, 108A*, 108B*, 108C*, 108D* with at least two different distances 151, 152, 153, 154, 155, 156, 157, 158 from the front portion 118 of the plug 104. Each of the plurality of contacts 108A, 108B, 108C, 108D on the top portion 110 may be coupled to one of the plurality of wires 106A, 106B, 106C, 106D and to one of the plurality of contacts 108A*, 108B*, 108C*, 108D* on the bottom portion 114. The coupling between the contacts 108A, 108B, 108C, 108D on the top portion 110 and the contacts 108A*, 108B*, 108C*, 108D* on the bottom portion 114 may be configured to maintain a same arrangement of contacts presented from top and bottom views and electrical paths to the plurality of wires 106A, 106B, 106C, 106D when the plug 104 is rotated one hundred eighty degrees.

According to an example embodiment, the electrical connector 100 may include the cord 102 insulating at least the first wire 106A, the second wire 106B, the third wire 106C, and the fourth wire 106D. The electrical connector 100 may also include the plug 104 extending from the cord 102. The plug 104 may include at least the top portion 110, the first side portion 112 adjacent to the top portion 110, the bottom portion 114 adjacent to the first side portion 112 and opposite from the top portion 110, the second side portion 116 adjacent to the top portion 110 and bottom portion 114 and opposite from the first side portion 112, the front portion 118 adjacent to the top portion 110, first side portion 112, bottom portion 114, and second side portion 116 and opposite from the cord 102.

The plug 104 may also include a plurality of electrical contacts. The plurality of electrical contacts may include at least the first electrical contact 108A on the top portion 110, the second electrical contact 108B on the top portion 110, the third electrical contact 108C on the top portion 110, the fourth electrical contact 108D on the top portion 110, a fifth electrical contact 108A* on the bottom portion 114, the sixth electrical contact 108B* on the bottom portion 114, the seventh electrical contact 108C* on the bottom portion 114, and the eighth electrical contact 108D* on the bottom portion 114.

In an example embodiment, the first electrical contact 108A may be coupled to the first wire 106A and may be closer to the first side portion 112 than the second electrical contact 108B, the third electrical contact 108C, and the fourth electrical contact 108D. The second electrical contact 108B may be coupled to the second wire 106B, may be farther from the first side portion 112 than the first electrical contact 108A, farther from the second side portion 116 than the third electrical contact 108C, and closer to the front portion 118 than the fourth electrical contact 108D. The third electrical contact 108C may be coupled to the third wire 106C and may be closer to the second side portion 116 than the first electrical contact 108A, the second electrical contact 108B, and the fourth electrical contact 108D. The fourth electrical contact 108D may be coupled to the fourth wire 106D and may be farther from the first side portion 112 than the first electrical contact 108A, farther from the front portion 118 than the second electrical contact 108B, and farther from the second side portion 116 than the third electrical contact 108C.

In an example embodiment, fifth electrical contact 108A* may be coupled to the first wire 106A and may be closer to the second side portion 116 than the sixth electrical contact 108B*, the seventh electrical contact 108C*, and the eighth electrical contact 108D*. The sixth electrical contact 108B* may be coupled to the second wire 106B and may be farther from the second side portion 116 than the fifth electrical contact 108A*, farther from the first side portion 112 than the seventh electrical contact 108C*, and closer to the front portion 118 than the eighth electrical contact 108D*. The seventh electrical contact 108C* may be coupled to the third wire 106C and may be closer to the first side portion 112 than the fifth electrical contact 108A*, the sixth electrical contact 108B*, and the eighth electrical contact 108D*. The eighth electrical contact 108D* may be coupled to the fourth wire 106D and may be farther from the second side portion 116 than the fifth electrical contact 108A*, farther from the front portion 118 than the sixth electrical contact 108B*, and farther from the first side portion 112 than the seventh electrical contact 108C*.

Figure 1D:
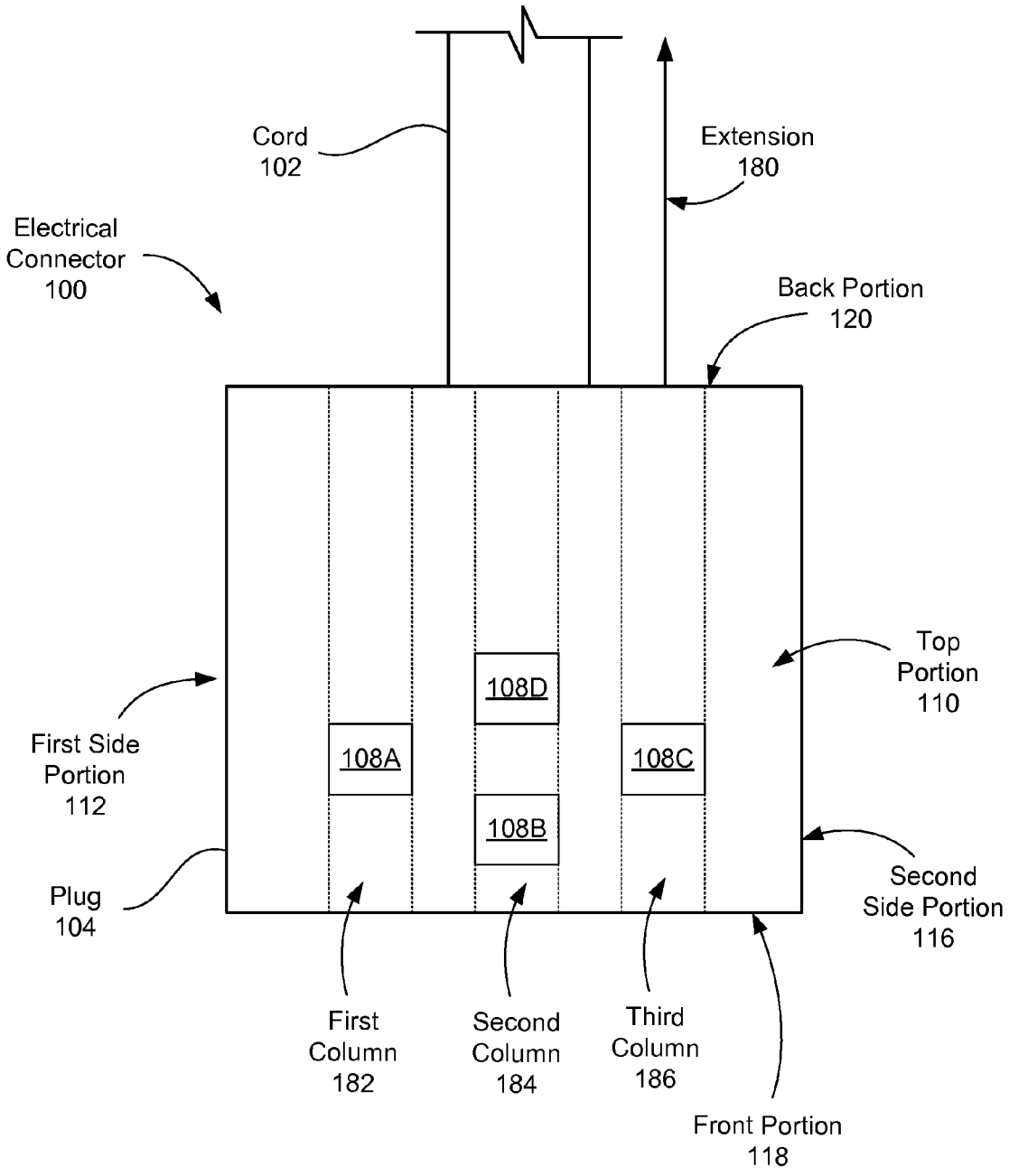
FIG. 1D is another top view of the electrical connector of FIG. 1A according to an example embodiment.

FIG. 1D is another top view of the electrical connector 100 of FIG. 1A according to an example embodiment. In this example, the electrical contacts on each of the top portion 110 and bottom portion 114 (not shown in FIG. 1D) may be arranged in a plurality of columns. The columns may extend parallel to an axis and/or imaginary line 180 extending from the back portion 120 of the plug 104 in a direction in which the cord 102 extends from the plug 104. The columns on the top portion 110 may be ordered and/or numbered sequentially from the first side portion 112 to the second side portion 116. As discussed further with respect to FIG. 1E below, the columns on the bottom portion 114 may be ordered and/or numbered sequentially from the second side portion 116 to the first side portion 112.

Each column may include either one or two contacts. A column on the top portion 110 may include a same number of contacts as a corresponding column on the bottom portion 114 of the same order or number. The contacts in columns with only one contact may be coupled to a contact in the column on the opposite side (top portion 110 or bottom portion 114) with the same order or number and to a same wire in the cord 102. Each of the contacts in columns with two contacts may be considered to be either a closer contact for being closer to the front portion 118 or a farther contact for being farther from the front portion 118. The closer contact(s) on the top portion 110 may be coupled to closer contact(s) on the bottom portion 114 that are included in column(s) of same order(s) or number(s). The farther contact(s) on the top portion 110 may be coupled to farther contact(s) on the bottom portion 114 that are included in column(s) of same order(s) or number(s).

In the example shown in FIG. 1D, a first column 182 on the top portion 110 includes the single first contact 108A, a second column 184 on the top portion 110 includes both the second contact 108B and fourth contact 108D, and a third column 186 on the top portion 110 includes the single third contact 108C. The first and third columns 182, 186 each include only a single contact, whereas the second column 184 includes two contacts. Within the second column 184, the second contact 108B may be considered the closer contact, and the fourth contact 108D may be considered the farther contact.

Figure 1E:
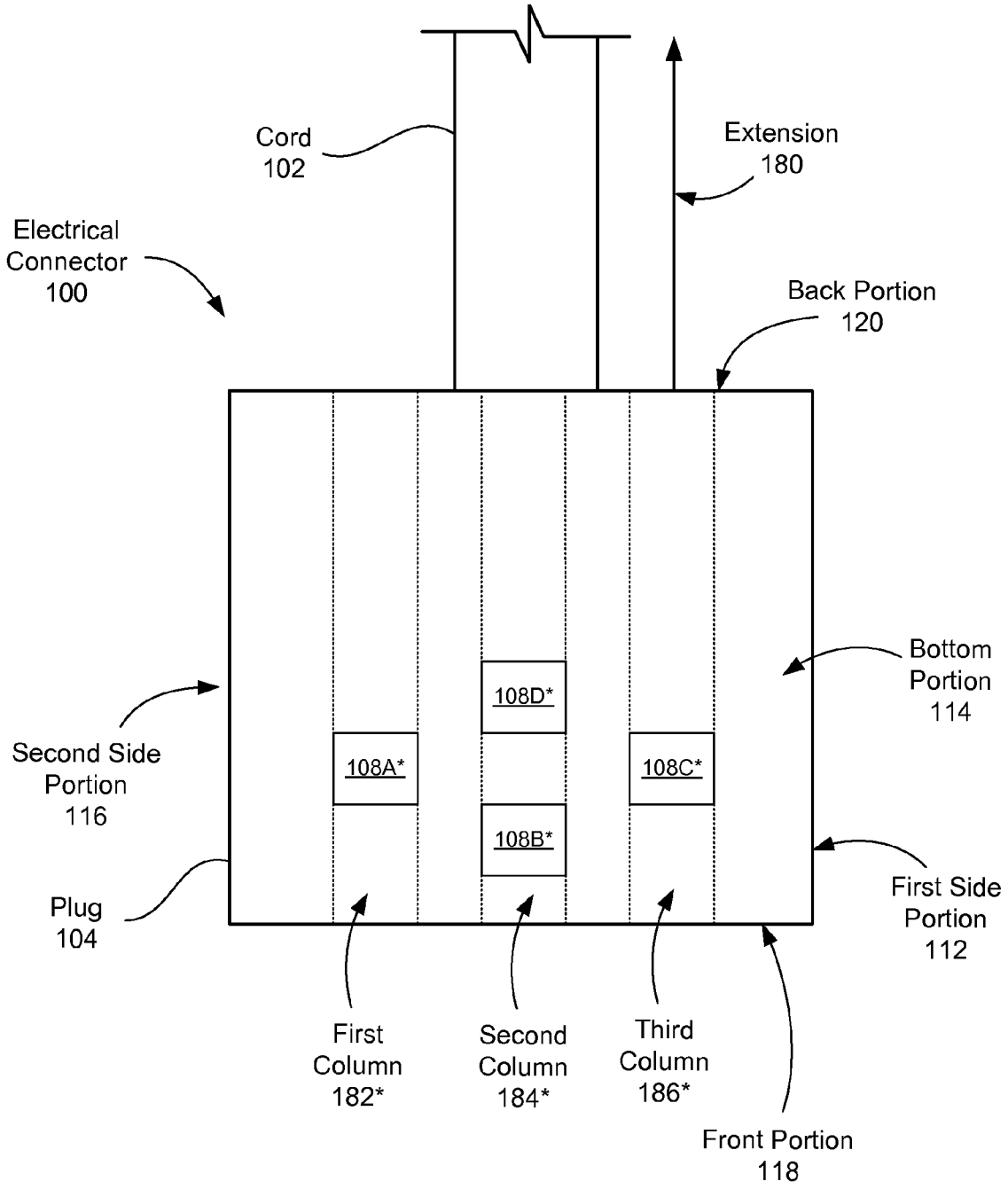
FIG. 1E is another bottom view of the electrical connector of FIG. 1A according to an example embodiment.

FIG. 1E is another bottom view of the electrical connector 100 of FIG. 1A according to an example embodiment. In this example, a first column 182* on the bottom portion 114 includes the fifth contact 108A, a second column 184* includes the sixth contact 108B* and the eighth contact 108D*, and a third column 186* includes the seventh contact 108C*. The first and third columns 182*, 186* each include only a single contact, whereas the second column 184* includes two contacts. Within the second column 184*, the sixth contact 108B* may be considered the closer contact, and the eighth contact 108D* may be considered the farther contact.

The first contact 108A, as the only contact within the first column 182 of the top portion 110, may be coupled to the only contact within the first column 182* of the bottom portion 114, namely the fifth contact 108A*. The second contact 108B, as the closer contact within the second column 184 of the top portion 110, may be coupled to the closer contact within the second column 184* of the bottom portion 114, namely the sixth contact 108B*. The fourth contact 108D, as the farther contact within the second column 184 of the top portion 110, may be coupled to the farther contact within the second column 184* of the bottom portion 114, namely the eighth contact 108D*. The third contact 108C, as the only contact within the third column 186 of the top portion 110, may be coupled to the only contact of the third column 186* of the bottom portion 114, namely the seventh contact 108C*. The inclusion of the contacts 108A, 108B, 108C, 108D, 108A*, 108B*, 108C*, 108D* in three columns 182, 184, 186, 182*, 184*, 186* on each of the top portion 110 and bottom portion 114, rather than four columns, may enable a reduction in an overall width of the plug 104.

While the example shown in FIGS. 1A, 1B, 1C, 1D, and 1E shows one column 184, 184* with two contacts 108B, 108D, 108B*, 108D* on each of the top and bottom portions 110, 114 of the plug 104, a plug may have multiple columns which each have two contacts. A plug with multiple columns which each have two contacts, with the front or closer contact mirrored and/or coupled to a front or closer contact in a column with a same order or number on the opposite (top or bottom) side of the plug, and the back or farther contact mirrored and/or coupled to a back or farther contact in the column with the same order on the opposite side of the plug.

Figure 2A:
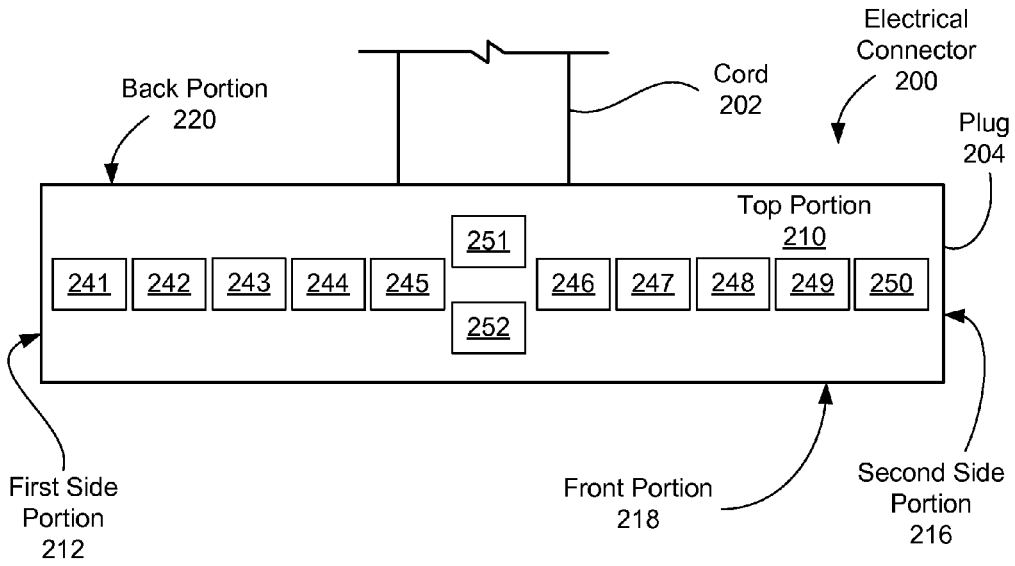
FIG. 2A is a top view of an electrical connector according to an example embodiment.

FIG. 2A is a top view of an electrical connector 200 according to an example embodiment. In this example, the electrical connector 200 may include a cord 202 and plug 204, which may have similar features to the cord 102 and plug 104 described above.

In the example shown in FIG. 2A, a top portion 210 of the plug 204 may include twelve contacts 241, 242, 243, 244, 245, 246, 247, 248, 249, 250, 251, 252. The top portion 210 may include eleven columns ordered or numbered sequentially from a first side portion 212 of the plug 204 to a second side portion 216 of the plug 204. The contacts 241, 242, 243, 244, 245, 246, 247, 248, 249, 250 may be included in columns which each include only one contact. The contacts 251, 252 may be included in a column that includes two contacts. The contact 251 may be considered the farther contact from a front portion 218 of the plug 204, and the contact 252 may be considered a closer contact to the front portion 218 of the plug 204.

Figure 2B:
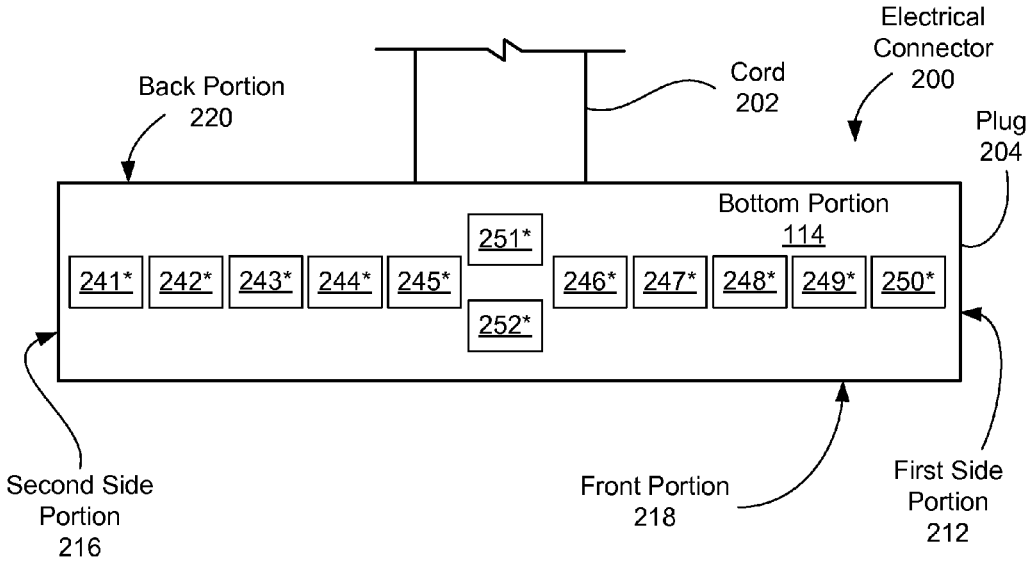
FIG. 2B is a bottom view of the electrical connector of FIG. 2A according to an example embodiment.

FIG. 2B is a bottom view of the electrical connector 100 of FIG. 2A according to an example embodiment. In the example shown in FIG. 2B, a bottom portion 214 of the plug 204 may include twelve contacts 241*, 242*, 243*, 244*, 245*, 246*, 247*, 248*, 249*, 250*, 251*, 252*. The bottom portion 214 may include eleven columns ordered or numbered sequentially from the second side portion 216 of the plug 204 to the first side portion 212 of the plug 204. The contacts 241*, 242*, 243*, 244*, 245*, 246*, 247*, 248*, 249*, 250* may be included in columns which each include only one contact. The contacts 251*, 252* may be included in a column that includes two contacts. The contact 251* may be considered the farther contact from the front portion 218 of the plug 204, and the contact 252* may be considered a closer contact to the front portion 218 of the plug 204.

Based on their inclusion within same ordered or numbered columns which include only a single contact, the contact 241 may be coupled to the contact 241*, the contact 242 may be coupled to the contact 242*, the contact 243 may be coupled to the contact 243*, the contact 244 may be coupled to the contact 245*, the contact 246 may be coupled to the contact 246*, the contact 247 may be coupled to the contact 247*, the contact 248 may be coupled to the contact 248*, the contact 249 may be coupled to the contact 248*, and the contact 250 may be coupled to the contact 250*.

Based on the contacts 251, 251* both being farther contacts and being in a same ordered or numbered column, the contacts 251, 251* may be coupled to each other. Based on the contacts 252, 252* both being closer contacts and being in a same ordered or numbered column, the contacts 252, 252* may be coupled to each other.

While the contacts in columns that include only a single contact have been described as coupled to a contact on the opposite side in a same ordered or numbered column, the contacts may instead carry differential signals, according to an example embodiment. In this example, instead of being coupled to each other, contacts may carry differential signals and/or power, carrying signals and/or power of equal magnitude and opposite polarity.

In an example USB implementation, the contacts 241, 241* may be coupled together and carry ground, the contacts 242, 242* may not be coupled together and may carry separate TX+ or positive transmitted signals, the contacts 243, 243* may not be coupled together and may carry separate TX− or negative transmitted signals, the contacts 244, 244* may be coupled together and may carry Vbus signals, the contacts 245, 245* may be coupled together and carry CC1 and CC2 signals, respectively, the contacts 246, 246* may be coupled together and may carry operator-defined signals, the contacts 247, 247* may be coupled together and carry ground, the contacts 248, 248* may not be coupled together and may carry separate RX− or negative received signals, the contacts 249, 249* may not be coupled together and may carry separate RX+ or positive received signals, the contacts 250, 250* may be coupled together and may carry Vbus signals, the contacts 251, 251* may be coupled together and may carry D+ signals, and the contacts 252, 252* may be coupled together and may carry D− signals. A plurality of contacts, in this example contacts 241, 241*, 244, 244*, 255, 255*, 246, 246*, 247, 247*, 250, 250*, may be mirrored and coupled to their corresponding mirrored node so that the same signals are transmitted when the plug 204 is rotated one hundred eighty degrees, with both contacts in the mirrored pair carrying signals that are combined. In this example, a plurality of contacts, in this example contacts 242, 242*, 243, 243*, 248, 248*, 249, 249*, are mirrored but are not coupled together and are interpreted and/or processed as distinct signals. In this example, a plurality of contacts, in this example contacts 251,251*, 252, 252* are mirrored and coupled together but, because the one pin on the socket will be contacting only one of the two mirrored contacts, the signal and/or power will be transmitted via only one of the contacts. The arrangement of the twenty-four contacts 241, 242, 243, 244, 245, 246, 247, 248, 249, 250, 241*, 242*, 243*, 244*, 245*, 246*, 247*, 248*, 249*, 250*, 251*, 252* on the top and bottom portions 210, 214 into eleven columns instead of twelve columns may reduce the width of the plug 204.

Figure 3A:
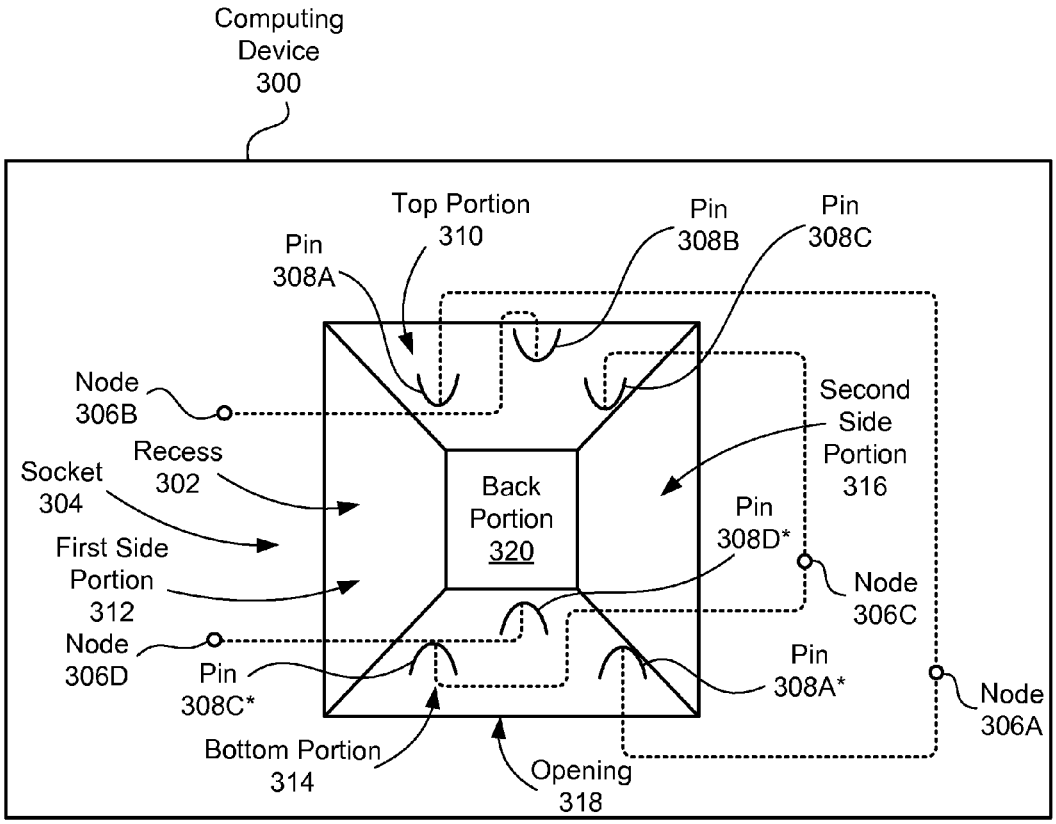
FIG. 3A is a diagram of a socket included in a computing device according to an example embodiment.

FIG. 3A is a diagram of an electrical socket 304 included in a computing device 300 according to an example embodiment. The socket 304 may include a USB socket, and/or may transmit and/or receive data according to a USB protocol. The socket 304 may include pins on both a top portion 310 and a bottom portion 314 of the socket 304 that are configured and/or located to engage and/or couple to the contacts of a plug, such as either of the plugs 104, 204 described above, included in columns that include only a single contact. The socket 304 may also include one or more pins on the top portion 310 that are configured to engage and/or couple with only the closer contacts that are included in columns with two contacts, and one or more pins on the bottom portion 314 that are configured to engage and/or couple with only the farther contacts that are included in columns with two contacts; alternatively, the socket 304 may include one or more pins on the top portion 310 that are configured to engage and/or couple with only the farther contacts that are included in the columns with two contacts, and one or more pins on the bottom portion 314 that are configured to engage and/or couple with only the closer contacts that are included in columns with two contacts. One of the top portion 310 or bottom portion 314 may include a pin(s) configured and/or located to engage the closer contact(s) but not the farther contact(s) included in a column(s) with two contacts, and the other of the top portion 310 or bottom portion 314 may include a pin(s) configured and/or located to engage the farther contact(s) but not the closer contact(s) included in the column(s) with two contacts.

The socket 304 may include a top portion 310, a first side portion 312 adjacent to the top portion 310, a bottom portion 314 adjacent to the first side portion 312 and opposite from the top portion 310, and a second side portion 316 adjacent to the top portion 310 and bottom portion 314 and opposite from the first side portion 312. The top portion 310, first side portion 312, bottom portion 314, and second side portion 316 may define a recess 302 of the socket 304. The top portion 310, first side portion 312, bottom portion 314, and second side portion 316 of the socket 304 may have similar dimensions to, and be slightly larger than, the top portion 110, first side portion 112, bottom portion 114, and second side portion 116, allowing the socket 304 to receive the plug 104.

The top portion 310 may include a first pin 308A, second pin 308B, and third pin 308C extending into the recess 302. The second pin 308B may be closer to an opening 318 of the socket 304 than the first pin 308A and third pin 308C, and/or may be farther from a back portion 320 of the socket 304 than the first pin 308A and third pin 308C.

The bottom portion 314 may include a fourth pin 308A*, a fifth pin 308D*, and a sixth pin 308C* extending into the recess 302. The fifth pin 308D* may be farther from the opening 318 than the fourth pin 308A* and sixth pin 308C*, and/or may be closer to the back portion 320 than the fourth pin 308A* and sixth pin 308C*.

The first pin 308A and fourth pin 308A* may be configured and/or located to engage and/or couple to the first contact 108A and/or fifth contact 108A* of the plug 104 described above, and may be coupled to a common node 306A. The second pin 308B may be configured and/or located to engage and/or couple to the second contact 108B and/or sixth contact 108B* of the plug 104 described above, and may be coupled to a node 306B. The third pin 308C and sixth pin 308C* may be configured and/or located to engage and/our couple to the third contact 108C and/or seventh contact 108C* of the plug 104 described above, and may be coupled to a common node 306C. The fifth pin 308D* may be configured and/or located to engage and/or couple to the fourth contact 108D and/or eighth contact 108D* of the plug 104 described above, and may be coupled to a node 306D.

Figure 3B:
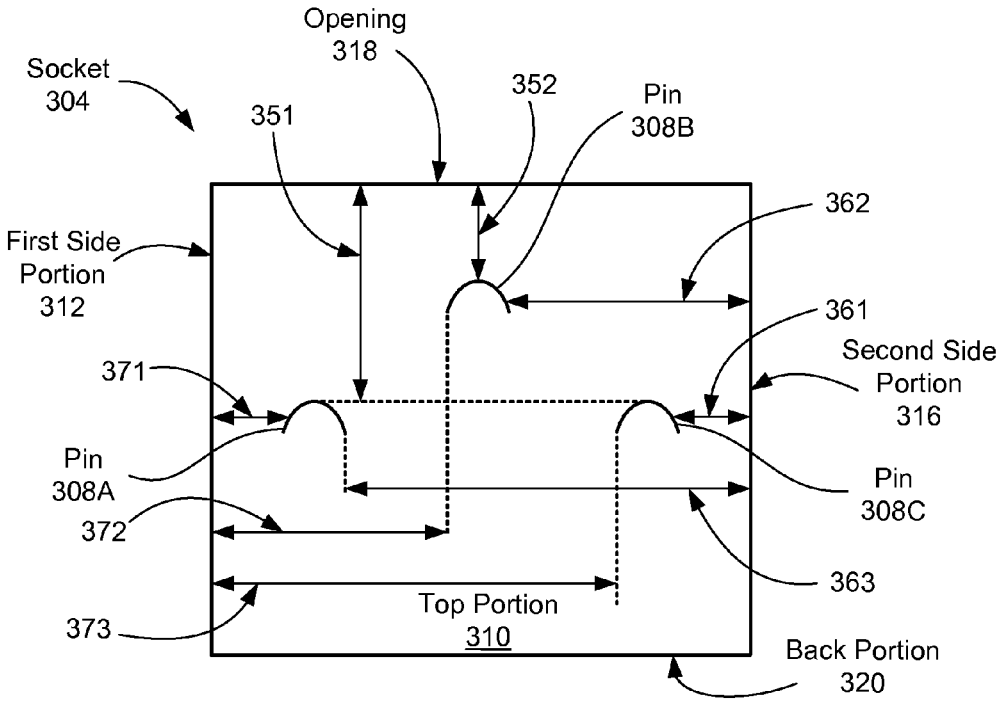
FIG. 3B is a diagram of a top portion of the socket of FIG. 3A according to an example embodiment.

FIG. 3B is a diagram of the top portion 310 of the socket 304 of FIG. 3A according to an example embodiment. The first and third pins 308A, 308C, which, as shown in FIG. 3A, are coupled to the fourth and sixth pins 308A*, 308C*, respectively, may be located and/or terminate a first distance 351 from the opening 318, and/or may be farther from the opening 318 than the second pin 308B. The first pin 308A may have a distance 371 that is smaller than or closer to the first side portion 312 than either the distance 372 of the second pin 308B from the first side portion 312 or the distance 373 of the third pin 308C from the side portion 312. The third pin 308C may have a distance 361 that is smaller or closer to the second side portion 316 than either the distance 362 of the second pin 308B from the second side portion 316 or the distance 363 of the first pin 308A from the second side portion 316.

The second pin 308B, which, as discussed above with respect to FIG. 3A, is not coupled to any of the other pins in the socket 304, may be located and/or terminate a second distance 352 from the opening 318, which may be smaller and/or closer to the opening 318 than either the first pin 308A or third pin 308C. The distance 372 of the second pin 308B from the first side portion 312 may be smaller and/or closer than the distance 373 between the third pin 308C and the first side portion 312, and may be larger and/or farther than the distance 371 between the first pin 308A and the first side portion. The distance 362 between the second pin 308B and the second side portion 316 may be smaller and/or closer than the distance 363 between the first pin 308A and the second side portion 316, and may be larger and/or farther than the distance 361 between the third pin 308C and the second side portion 316.

Figure 3C:
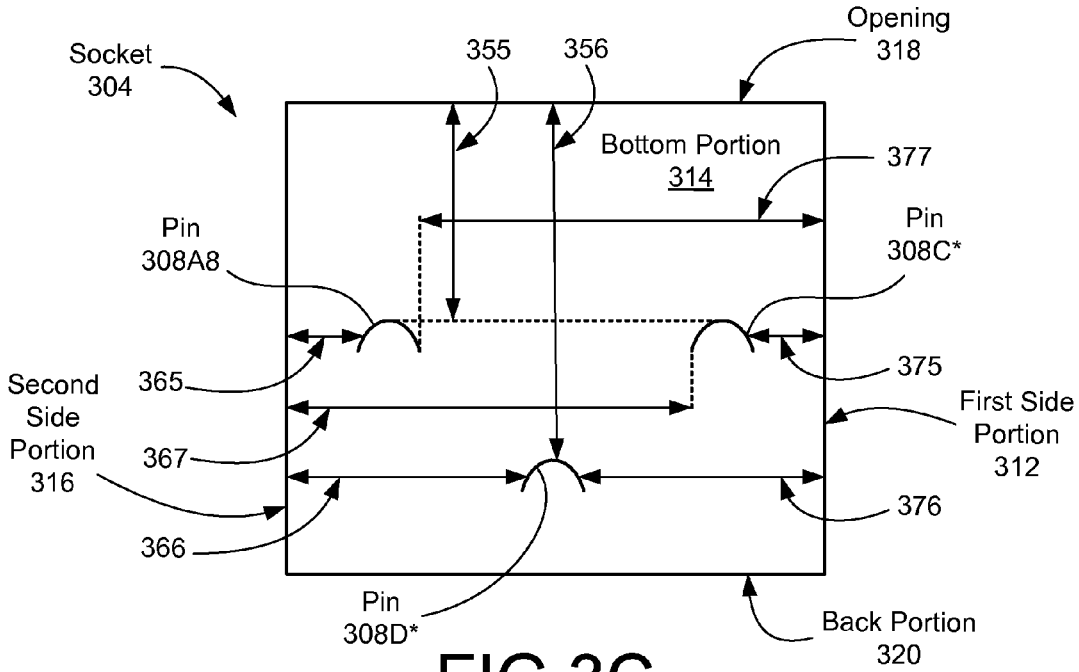
FIG. 3C is a diagram of a bottom portion of the socket of FIG. 3A according to an example embodiment.

FIG. 3C is a diagram of the bottom portion 314 of the socket 304 of FIG. 3A according to an example embodiment. The fourth and sixth pins 308A*, 308C*, which, as shown in FIG. 3A, are coupled to the first and third pins 308A, 308C, respectively, may terminate and/or be located a first distance 355 from the opening 318. The first distance 355 from the opening 318 that the fourth and sixth pins 308A*, 308C* are located and/or terminate may be the same as the first distance 351 from the opening 318 that the first and third pins 308A, 308C are located and/or terminated. A distance 365 of the fourth pin 308A* from the second side portion 316 may be smaller or less than distances 366, 367 of the fifth pin 308D* and sixth pin 308C* from the second side portion 316. A distance 375 of the sixth pin 308C* from the first side portion 312 may be less than distances 376, 377 of the fifth pin 308D* and fourth pin 308A* from the first side portion 312.

The fifth pin 308D*, which, as discussed above with respect to FIG. 3A, is not coupled to any of the other pins in the socket 304, may be located and/or terminate a third distance 356 from the opening 318. The third distance 356 may be greater than or farther than the first distance 355. The fifth pin 308D* may also have a distance 366 from the second side portion 316 that is greater than the distance 365 of the fourth pin 308A* from the second side portion 316 and is less than a distance 367 of the sixth pin 308C* from the second side portion 316. The fifth pin 308D* may also have a distance 376 from the first side portion 312 that is less than a distance 377 of the fourth pin 308A* from the first side portion 312 and is greater than a distance 375 of the fourth pin 308C* from the first side portion 312.

Referring to both FIGS. 3B and 3C, the first distance 351, 355 from the opening 318 that the first, third, fourth, and sixth pins 308A, 308C, 308A*, 308C* are located and/or terminate may be greater and/or farther than the second distance 352 from the opening 318 that the second pin 308B is located and/or terminates, and may be less and/or closer than the third distance 356 from the opening 318 that the fifth pin 308D* is located and/or terminates. Or, the first distance 351, 355 may be the same as the second distance 352 and less than the third distance 356. Or, the first distance 351, 355 may be greater than the second distance 352 and the same as the third distance 356.

While the second pin 308B has been described as between the first and third pins 308A, 308C, and the fifth pin 308D* has been described as between the fourth and sixth pins 308C*, 308A*, the pins that are not coupled to any other pins, such as the second and fifth pins 308B, 308D* may also be located on outer portions of the top portion 310 and bottom portion 314 and/or closer to the first and second side portions 312, 316. While four pins 308A, 308B, 308C, 308C*, 308D*, 308A* have been described herein, more pins may be included, with pins that are coupled to a pin on an opposite top or bottom portion 310, 314 being the second distance 351, 355 from the opening 318, pins on the top portion 310 that are not coupled to any other pin being the second distance 352 from the opening 318, and pins on the bottom portion 314 that are not coupled to any other pin being the third distance 356 from the opening 318.

Referring to FIGS. 1A, 1B, 1C, 1D, 1E, 3A, 3B, and 3C, depending on the orientation of the plug 104, when the plug 104 is inserted into the socket 304, the first pin 308A may engage either the first contact 108A or the fifth contact 108A*, and the fourth pin 308A* may engage the other contact 108A, 108A* not engaged by the pin first 308A. The third pin 308C may engage either the third contact 108C or the seventh contact 108C*, and the sixth pin 308C* may engage the other contact 108C, 108C* not engaged by the third pin 308C. The second pin 308B may engage either the second contact 108B or sixth contact 108B*. The fifth pin 308D* may engage either the fourth contact 108D or the eighth contact 108D*.

The coupling of two pins, such as the first and fourth pins 308A, 308A*, to two contacts 108A, 108A* and/or the third and sixth pins 308C, 308C* to two contacts 108A, 108A*, that are coupled to each other, may allow transmission of data and/or power at rates that may exceed the capacity of a single pin, contact, and/or wire. The coupling of the single pin, such as the second pin 308B to either the second contact 108B or the sixth contact 108B*, or the fourth pin 308D to either the fourth contact 108D or eighth contact 108D*, may be implemented when a single pin, contact, and/or wire is sufficient to transmit the necessary data and/or power. Data and/or power which can be transmitted via a single pin, contact, and/or wire may be transmitted via contacts 108B, 108D, 108D, 108D* included in a column 184, 184* with two contacts 108B, 108D, 108D, 108D* included and/or via pins 308B, 308D* that are the second or third distance 352, 356 from the opening 318. Data and/or power which requires two pins, contacts, and/or wires for transmission may be transmitted via contacts 108A, 108A*, 108C, 108C* included in a column 182, 182*, 186, 186* with only one contact 108A, 108A*, 108C, 108C* and/or via pins 308A, 308A*, 308C, 308C* that are the first distance 351, 355 from the opening 318.

Figure 4A:
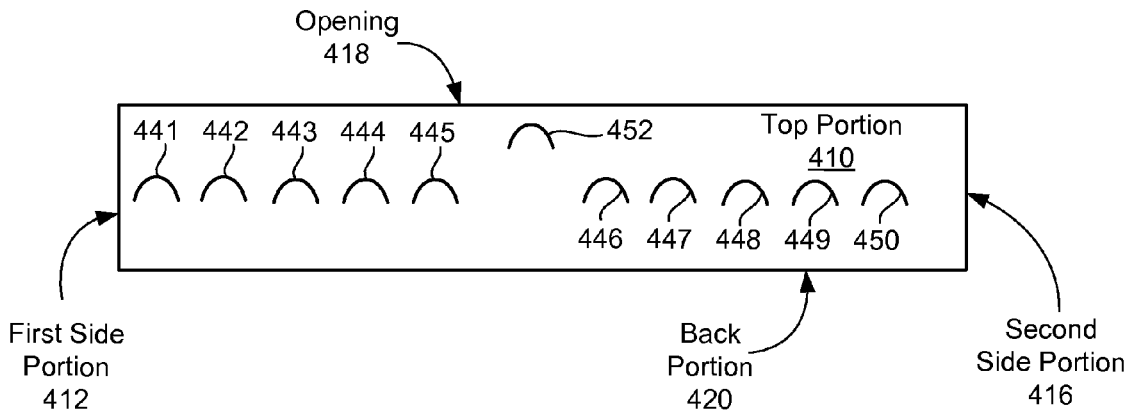
FIG. 4A is a diagram of a top portion of a socket according to an example embodiment.

FIG. 4A is a diagram of a top portion 410 of a socket (not labeled) according to an example embodiment. In this example, five pins 441, 442, 443, 444, 445 may be a first distance from an opening 418 of the socket and closer to a first side portion 412 of the socket, similar to the first pin 308A described above, and may each be coupled to a pin on a bottom portion described below with respect to FIG. 4B. Also in this example, five pins 446, 447, 448, 449, 450 may be the first distance from the opening 418 of the socket and closer to a second side portion 416 of the socket, similar to the third pin 308C described above, and may each be coupled to a pin on the bottom portion described below with respect to FIG. 4B. Also in this example, a single pin 452 may be a second distance from the opening 418 and between the pins 441, 442, 443, 444, 445, 446, 447, 448, 449, 450 with respect to the first and second side portions 412, 416, and may not be coupled to any other pin in the socket, similar to the second pin 308B described above.

Figure 4B:
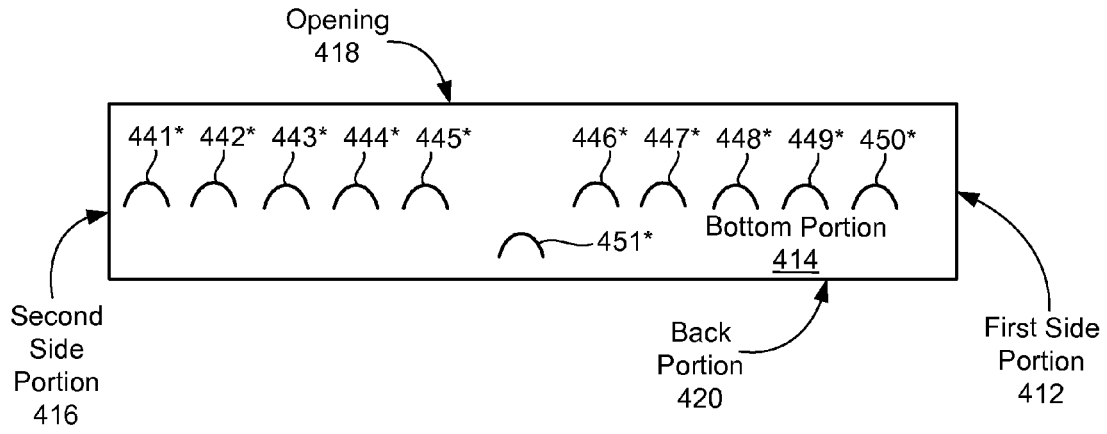
FIG. 4B is a diagram of a bottom portion of the socket of FIG. 4A according to an example embodiment.

FIG. 4B is a diagram of a bottom portion 414 of the socket of FIG. 4A according to an example embodiment. In this example, five pins 441*, 442*, 443*, 444*, 445* may be the first distance from an opening 418 of the socket and closer to the second side portion 416 of the socket, similar to the fourth pin 308A* described above, and may each be coupled to a pin on the portion 410 described above with respect to FIG. 4A. Also in this example, five pins 446*, 447*, 448*, 449*, 450* may be the first distance from the opening 418 of the socket and closer to the first side portion 412 of the socket, similar to the sixth pin 308C* described above, and may each be coupled to a pin on the top portion 410 described above with respect to FIG. 4A. Also in this example, a single pin 451* may be a third distance from the opening 418 and between the pins 441*, 442*, 443*, 444*, 445*, 446*, 447*, 448*, 449*, 450* with respect to the first and second side portions 412, 416, and may not be coupled to any other pin in the socket, similar to the fifth pin 308D* described above.

Referring to both FIGS. 4A and 4B, the following pairs of pins may either be coupled to each other or carry differential signals or power: 441 and 441*, 442 and 442*, 443 and 443*, 444 and 444*, 445 and 445*, 446 and 446*, 447 and 447*, 448 and 448*, 449 and 449*, and 450 and 450*. Referring to FIGS. 2A, 2B, 4A, and 4B, depending on how the plug 204 is oriented, when the plug 204 is inserted into the socket, contacts 241 and 241* may each engage one of either pin 441 or 441*, contacts 242 and 242* may each engage one of either pin 442 or 442*, contacts 243 and 243* may each engage one of either pin 443 or 443*, contacts 244 and 244* may each engage one of either pin 444 or 444*, contacts 245 and 245* may each engage one of either pin 445 or 445*, contacts 246 and 246* may each engage one of either pin 446 or 446*, contacts 247 and 247* may each engage one of either pin 447 or 447*, contacts 248 and 248* may each engage one of either pin 448 or 448*, contacts 249 and 249* may each engage one of either pin 449 or 449*, and contacts 250 and 250* may each engage one of either pin 450 or 450*. The pin 452 may couple to either the node 252 or the node 252*, and the pin 451 may couple to either the node 251 or the node 251*.

Figure 5A:
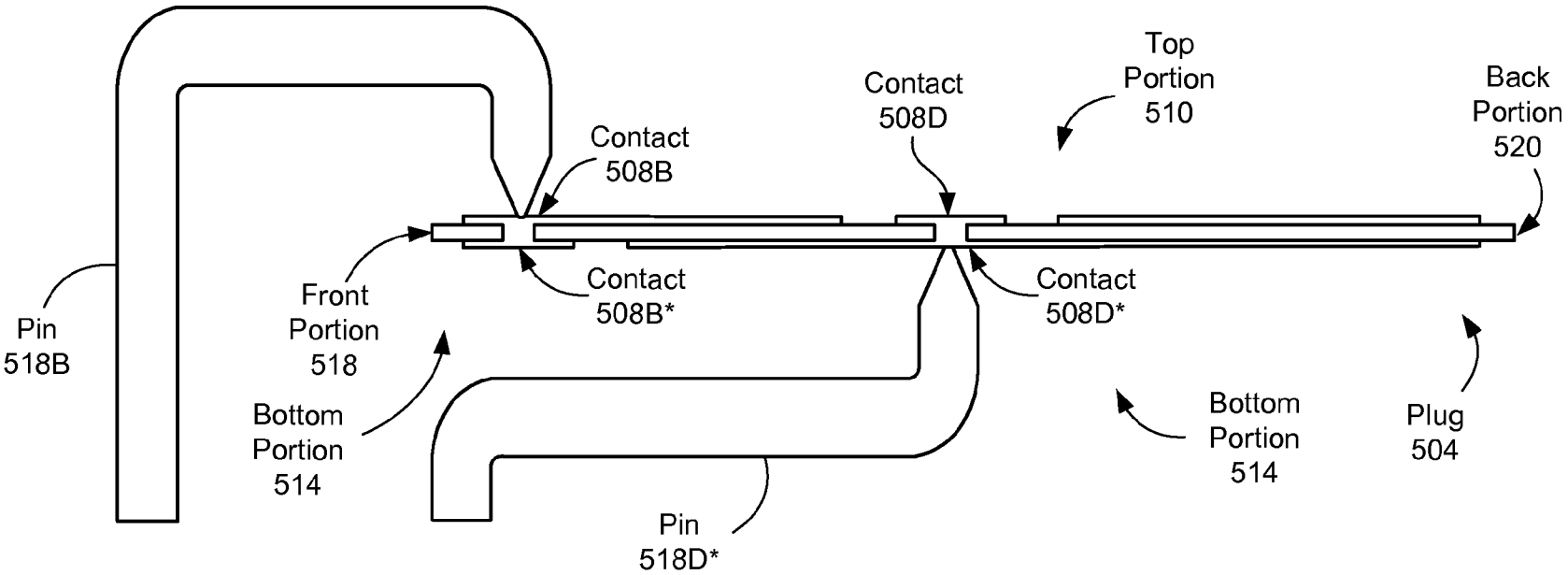
FIG. 5A is a diagram of a plug and pins contacting the plug according to an example embodiment.

FIG. 5A is a diagram of a plug 504 and pins 518B, 518D* contacting the plug 504 according to an example embodiment. The plug 504 may have similar features to either or both of the plugs 104, 204 described above. The pins 518B, 518D* may be included in a socket, such as a socket described above, and may be examples of the pins 308B, 308D* described above with respect to FIGS. 3A, 3B, and 3C, and/or of the pins 452, 451* described above with respect to FIGS. 4A and 4B.

In FIG. 5A, a top portion 510 of the plug 504 is facing toward a top of the page, and toward the pin 518B. The plug 504 may include the two contacts 508B, 508D in a single column on the top portion 510 of the plug 504, and may include the two contacts 508B*, 508D* in a single column on the bottom portion 510 of the plug 504. The plug 504 may also include other contacts not shown in FIG. 5A.

The contact 508B may be coupled to the contact 508B*, and the contact 508D may be coupled to the contact 508D*. The contacts 508B, 508B* may be considered the closer contacts in the column based on being closer to the front portion 518 of the plug 504 and/or farther from the back portion 520. The contacts 508D, 508D* may be considered the farther contacts in the column based on being farther from the front portion 518 and/or closer to the back portion 520.

When the plug 504 is inserted into the socket (not shown in FIG. 5A) with the top portion 510 facing up, the pin 518B may engage the contact 508B and the pin 518D* may engage the contact 508D*. Based on the coupling between the contacts 508B and 508B*, the contacts 508B, 508B* are coupled to the pin 518B. Similarly, the pin 518D* may engage the contact 508D*, and based on the coupling between the contacts 508D and 508D*, the contacts 508D, 508D* are coupled to the pin 518D*.

Figure 5B:
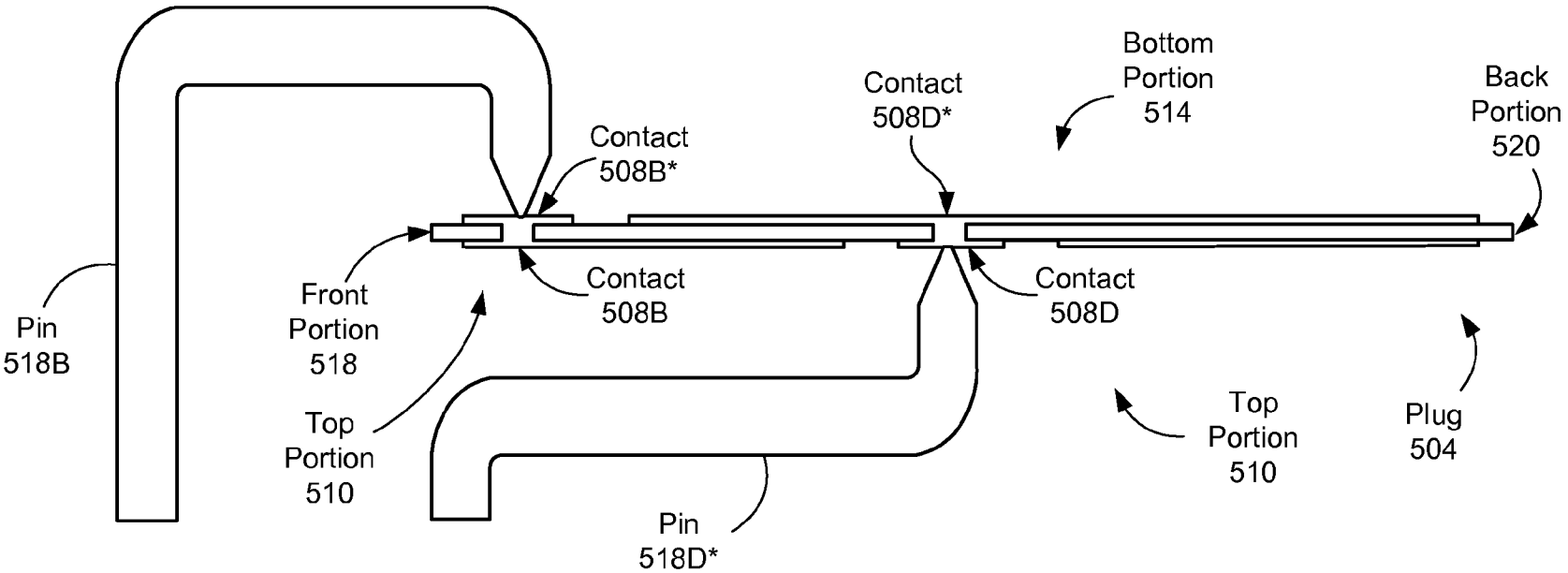
FIG. 5B is a diagram of the plug and pins of FIG. 5A according to an example embodiment in which the plug has been rotated upside-down.

FIG. 5B is a diagram of the plug and pins of FIG. 5A according to an example embodiment in which the plug 504 has been rotated upside-down. In this example, with the plug 504 inserted into the socket (not shown in FIG. 5B) with the bottom portion 514 facing up, the pin 518B engages the contact 508B* and the pin 518D* engages the contact 508D. Based on the coupling between the contacts 508B* and 508B, the pin 518B is coupled to both contacts 508B, 508B*, as in the example of FIG. 5A with the top portion 510 facing up. Based on the coupling between the contacts 508D*, 508D, the pin 518D* is coupled to both contacts 508D, 508D*, as in the example of FIG. 5A with the top portion 510 facing up.

Figure 7A:
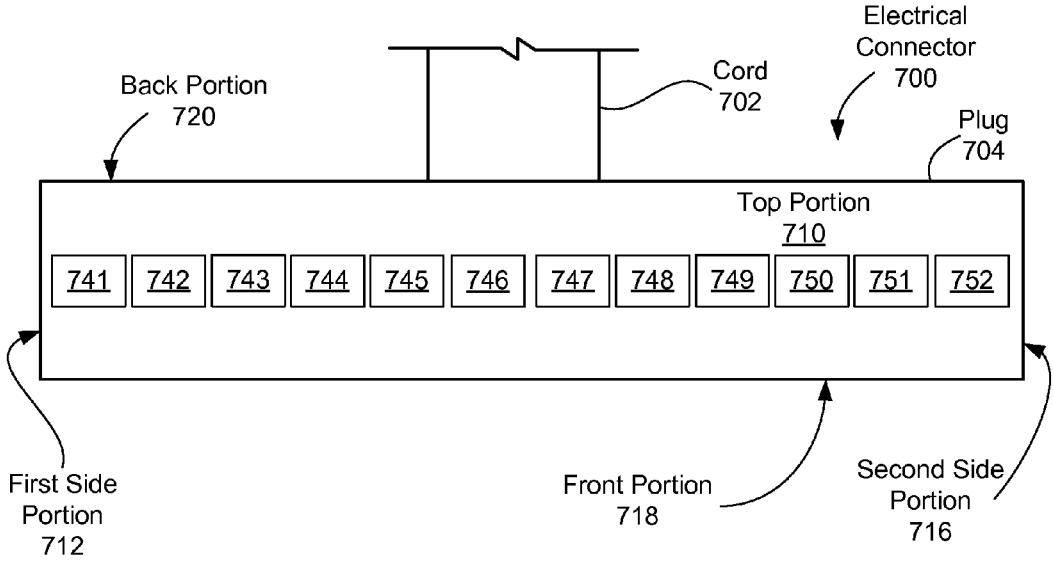
FIG. 7A is a top view of an electrical connector according to an example embodiment.

FIG. 7A is a top view of an electrical connector 700 according to an example embodiment. In this example, the electrical connector 200 may include a cord 702 and plug 704, which may have similar features to the cord 102 and plug 104 described above.

In the example shown in FIG. 7A, a top portion 710 of the plug 704 may include twelve contacts 741, 742, 743, 744, 745, 746, 747, 748, 749, 750, 751, 752. The top portion 710 may include twelve columns ordered or numbered sequentially from a first side portion 712 of the plug 704 to a second side portion 716 of the plug 704. The contacts 741, 742, 743, 744, 745, 746, 747, 748, 749, 750, 751, 752 may all be included in columns which each include only one contact. In this example, the top portion 710 of the plug 704 may not include any columns that have two contacts.

Figure 7B:
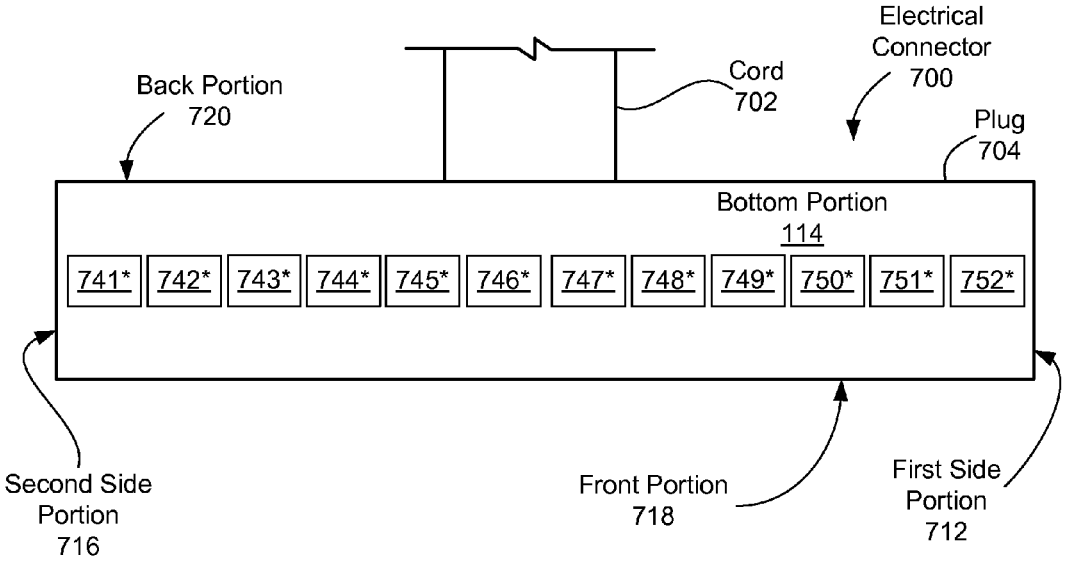
FIG. 7B is a bottom view of the electrical connector of FIG. 7A according to an example embodiment.

FIG. 7B is a bottom view of the electrical connector 100 of FIG. 7A according to an example embodiment. In the example shown in FIG. 7B, a bottom portion 714 of the plug 704 may include twelve contacts 741*, 742*, 743*, 744*, 745*, 746*, 747*, 748*, 749*, 750*, 751*, 752*. The bottom portion 714 may include twelve columns ordered or numbered sequentially from the second side portion 716 of the plug 704 to the first side portion 712 of the plug 704. The contacts 741*, 742*, 743*, 744*, 745*, 746*, 747*, 748*, 749*, 750*, 751*, 752* may be included in columns which each include only one contact. In this example, the bottom portion 714 of the plug 704 may not include any columns that have two contacts.

Based on their inclusion within same ordered or numbered columns which include only a single contact, the contact 741 may be coupled to the contact 741*, the contact 742 may be coupled to the contact 742*, the contact 743 may be coupled to the contact 743*, the contact 744 may be coupled to the contact 744*, the contact 745 may be coupled to the contact 745*, the contact 746 may be coupled to the contact 746*, the contact 747 may be coupled to the contact 747*, the contact 748 may be coupled to the contact 748*, the contact 749 may be coupled to the contact 749*, the contact 750 may be coupled to the contact 750*, the contact 751 may be coupled to the contact 751*, and the contact 752 may be coupled to contact 752*.

In an example USB implementation, the contacts 741, 741* may be coupled together and carry ground, the contacts 742, 742* may not be coupled together and may carry separate TX+ or positive transmitted signals, the contacts 743, 743* may not be coupled together and may carry separate TX− or negative transmitted signals, the contacts 744, 744* may be coupled together and may carry Vbus signals, the contacts 745, 745* may be coupled together and carry CC1 and CC2 signals, respectively, the contacts 746, 746* may be coupled together and may carry D+ signals, the contacts 747, 747* may be coupled together and may carry D− signals, the contacts 748, 748* may be coupled together and carry operator-defined signals, the contacts 749, 749* may be coupled together and carry ground, the contacts 750, 750* may not be coupled together and may carry separate RX− or negative received signals, the contacts 751, 751* may not be coupled together and may carry separate RX+ or positive received signals, and the contacts 752, 752* may be coupled together and may carry Vbus signals. A plurality of contacts, in this example contacts 741, 741*, 744, 744*, 755, 755*, 746, 746*, 747, 747*, 750, 750*, may be mirrored and coupled to their corresponding mirrored node so that the same signals are transmitted when the plug 704 is rotated one hundred eighty degrees, with both contacts in the mirrored pair carrying signals that are combined. In this example, a plurality of contacts, in this example contacts 742, 742*, 743, 743*, 748, 748*, 749, 749*, are mirrored but are not coupled together and are interpreted and/or processed as distinct signals.

Figure 8A:
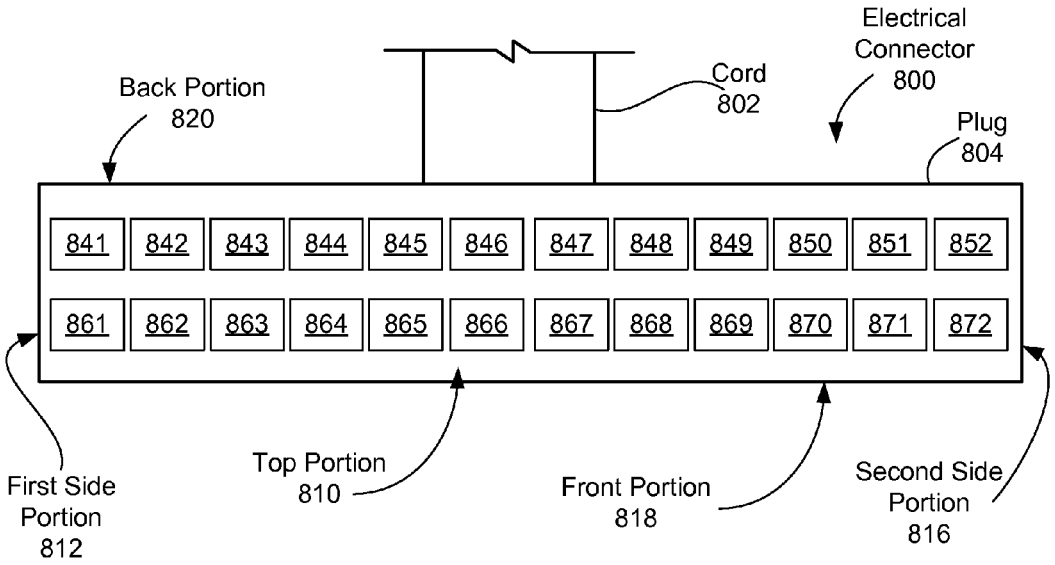
FIGS. 8A and 8B show top and bottom views of an electrical connector according to an example embodiment.
Figure 8B:
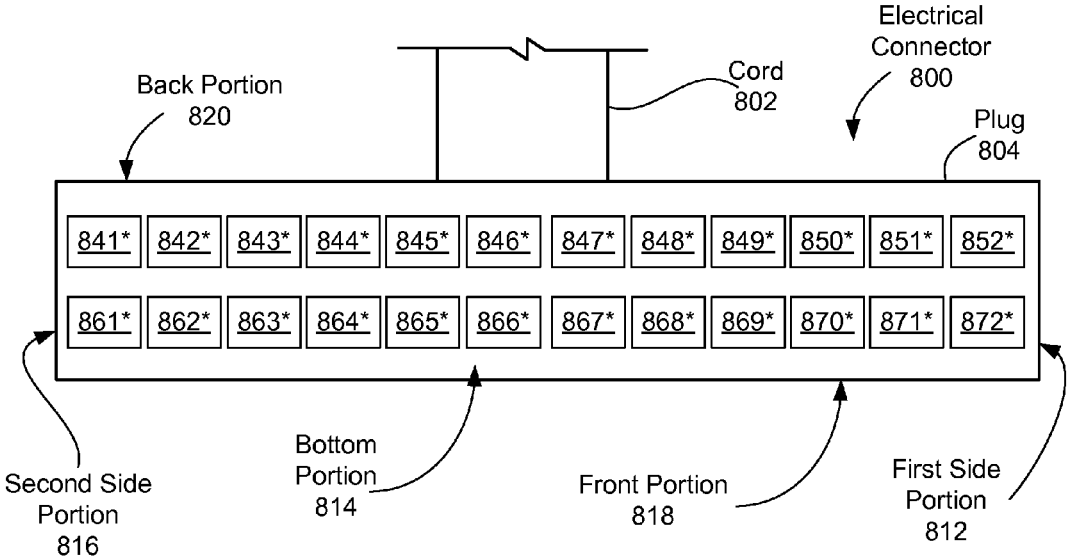

FIGS. 8A and 8B show top and bottom views of an electrical connector 800 according to an example embodiment. In this example, each of the top and bottom portions 810, 814 of the plug 804 includes twelve columns, with each column including two contacts. The farther contacts on the top portion 810, contacts 841, 842, 843, 844, 845, 846, 847, 848, 849, 850, 851, 852, may be coupled to their respective mirrored farther contacts on the bottom portion 814, contacts 841*, 842*, 843*, 844*, 845*, 846*, 847*, 848*, 849*, 850*, 851*, 852*. Contact 841 may be coupled to 841*, 842 may be coupled to 842*, 843 may be coupled to 843*, 844 may be coupled to 844*, 845 may be coupled to 845*, 846 may be coupled to 846*, 847 may be coupled to 847*, 848 may be coupled to 848*, 849 may be coupled to 849*, 850 may be coupled to 850*, 851 may be coupled to 851*, and 852 may be coupled to 852*. The closer contacts on the top portion 810, contacts 861, 862, 863, 864, 865, 866, 867, 868, 869, 860,

861, 862, may be coupled to their respective mirrored farther contacts on the bottom portion 814, contacts 861*, 862*, 863*, 864*, 865*, 866*, 867*, 868*, 869*, 860*, 861*, 862*. Contact 861 may be coupled to 861*, 862 may be coupled to 862*, 863 may be coupled to 863*, 864 may be coupled to 864*, 865 may be coupled to 865*, 866 may be coupled to 866*, 867 may be coupled to 867*, 868 may be coupled to 868*, 869 may be coupled to 869*, 870 may be coupled to 870*, 871 may be coupled to 871*, and 872 may be coupled to 872*.

In an example in which twelve pins on a top portion of a socket are closer to the opening, and pins on a bottom portion of the socket are farther from the opening, when the plug 804 is inserted into the socket with the top portion facing up toward the top portion of the socket, the contacts 861, 862, 863, 864, 865, 866, 867, 868, 869, 860, 861, 862 may engage the pins on the top portion of the socket, and the contacts 841, 842, 843, 844, 845, 846, 847, 848, 849, 850, 851, 852 may not be engaged with any pin. In this example, the contacts 841*, 842*, 843*, 844*, 845*, 846*, 847*, 848*, 849*, 850*, 851*, 852* may be engaged with the pins on the bottom of the socket, and the contacts 861*, 862*, 863*, 864*, 865*, 866*, 867*, 868*, 869*, 860*, 861*, 862* may not be engaged with any pin.

If the plug 804 is rotated so that the bottom portion 814 is facing the top portion of the socket, then the contacts 861*, 862*, 863*, 864*, 865*, 866*, 867*, 868*, 869*, 860*, 861*, 862* may engage the pins on the top portion of the socket, and the contacts 841*, 842*, 843*, 844*, 845*, 846*, 847*, 848*, 849*, 850*, 851*, 852* may not be engaged with any pin. With the bottom portion 814 facing up, the contacts 841, 842, 843, 844, 845, 846, 847, 848, 849, 850, 851, 852 may be engaged with the pins on the bottom of the socket, and the contacts 861, 862, 863, 864, 865, 866, 867, 868, 869, 860, 861, 862 may not be engaged with any pin.

Figure 6:
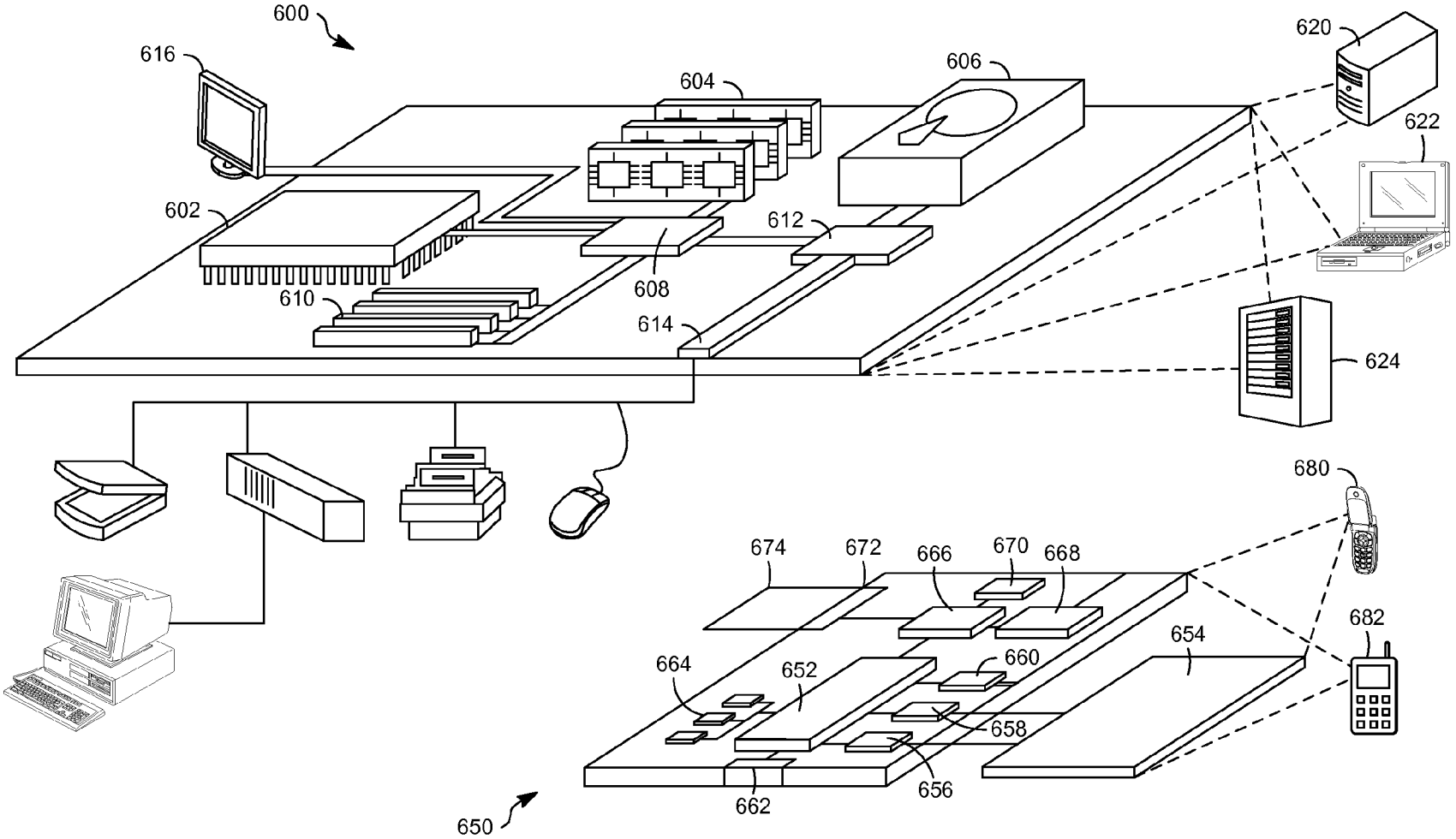
FIG. 6 shows an example of a generic computer device and a generic mobile computer device.

FIG. 6 shows an example of a generic computer device 600 and a generic mobile computer device 650, which may be used with the techniques described here. Computing device 600 is intended to represent various forms of digital computers, such as laptops, desktops, workstations, personal digital assistants, servers, blade servers, mainframes, and other appropriate computers. Computing device 650 is intended to represent various forms of mobile devices, such as personal digital assistants, cellular telephones, smart phones, and other similar computing devices. The components shown here, their connections and relationships, and their functions, are meant to be exemplary only, and are not meant to limit implementations of the inventions described and/or claimed in this document. Either of the computing devices 600, 650 may include the computing device 300 described above, and/or may include any of the sockets described herein, and/or may be coupled to any of the electrical connectors described herein.

Computing device 600 includes a processor 602, memory 604, a storage device 606, a high-speed interface 608 connecting to memory 604 and high-speed expansion ports 610, and a low speed interface 612 connecting to low speed bus 614 and storage device 606. Each of the components 602, 604, 606, 608, 610, and 612, are interconnected using various busses, and may be mounted on a common motherboard or in other manners as appropriate. The processor 602 can process instructions for execution within the computing device 600, including instructions stored in the memory 604 or on the storage device 606 to display graphical information for a GUI on an external input/output device, such as display 616 coupled to high speed interface 608. In other implementations, multiple processors and/or multiple buses may be used, as appropriate, along with multiple memories and types of memory. Also, multiple computing devices 600 may be connected, with each device providing portions of the necessary operations (e.g., as a server bank, a group of blade servers, or a multi-processor system).

The memory 604 stores information within the computing device 600. In one implementation, the memory 604 is a volatile memory unit or units. In another implementation, the memory 604 is a non-volatile memory unit or units. The memory 604 may also be another form of computer-readable medium, such as a magnetic or optical disk.

The storage device 606 is capable of providing mass storage for the computing device 600. In one implementation, the storage device 606 may be or contain a computer-readable medium, such as a floppy disk device, a hard disk device, an optical disk device, or a tape device, a flash memory or other similar solid state memory device, or an array of devices, including devices in a storage area network or other configurations. A computer program product can be tangibly embodied in an information carrier. The computer program product may also contain instructions that, when executed, perform one or more methods, such as those described above. The information carrier is a computer- or machine-readable medium, such as the memory 604, the storage device 606, or memory on processor 602.

The high speed controller 608 manages bandwidth-intensive operations for the computing device 600, while the low speed controller 612 manages lower bandwidth-intensive operations. Such allocation of functions is exemplary only. In one implementation, the high-speed controller 608 is coupled to memory 604, display 616 (e.g., through a graphics processor or accelerator), and to high-speed expansion ports 610, which may accept various expansion cards (not shown). In the implementation, low-speed controller 612 is coupled to storage device 606 and low-speed expansion port 614. The low-speed expansion port, which may include various communication ports (e.g., USB, Bluetooth, Ethernet, wireless Ethernet) may be coupled to one or more input/output devices, such as a keyboard, a pointing device, a scanner, or a networking device such as a switch or router, e.g., through a network adapter.

The computing device 600 may be implemented in a number of different forms, as shown in the figure. For example, it may be implemented as a standard server 620, or multiple times in a group of such servers. It may also be implemented as part of a rack server system 624. In addition, it may be implemented in a personal computer such as a laptop computer 622. Alternatively, components from computing device 600 may be combined with other components in a mobile device (not shown), such as device 650. Each of such devices may contain one or more of computing device 600, 650, and an entire system may be made up of multiple computing devices 600, 650 communicating with each other.

Computing device 650 includes a processor 652, memory 664, an input/output device such as a display 654, a communication interface 666, and a transceiver 668, among other components. The device 650 may also be provided with a storage device, such as a microdrive or other device, to provide additional storage. Each of the components 650, 652, 664, 654, 666, and 668, are interconnected using various buses, and several of the components may be mounted on a common motherboard or in other manners as appropriate.

The processor 652 can execute instructions within the computing device 650, including instructions stored in the memory 664. The processor may be implemented as a chipset of chips that include separate and multiple analog and digital processors. The processor may provide, for example, for coordination of the other components of the device 650, such as control of user interfaces, applications run by device 650, and wireless communication by device 650.

Processor 652 may communicate with a user through control interface 658 and display interface 656 coupled to a display 654. The display 654 may be, for example, a TFT LCD (Thin-Film-Transistor Liquid Crystal Display) or an OLED (Organic Light Emitting Diode) display, or other appropriate display technology. The display interface 656 may comprise appropriate circuitry for driving the display 654 to present graphical and other information to a user. The control interface 658 may receive commands from a user and convert them for submission to the processor 652. In addition, an external interface 662 may be provide in communication with processor 652, so as to enable near area communication of device 650 with other devices. External interface 662 may provide, for example, for wired communication in some implementations, or for wireless communication in other implementations, and multiple interfaces may also be used.

The memory 664 stores information within the computing device 650. The memory 664 can be implemented as one or more of a computer-readable medium or media, a volatile memory unit or units, or a non-volatile memory unit or units. Expansion memory 674 may also be provided and connected to device 650 through expansion interface 672, which may include, for example, a SIMM (Single In Line Memory Module) card interface. Such expansion memory 674 may provide extra storage space for device 650, or may also store applications or other information for device 650. Specifically, expansion memory 674 may include instructions to carry out or supplement the processes described above, and may include secure information also. Thus, for example, expansion memory 674 may be provide as a security module for device 650, and may be programmed with instructions that permit secure use of device 650. In addition, secure applications may be provided via the SIMM cards, along with additional information, such as placing identifying information on the SIMM card in a non-hackable manner.

The memory may include, for example, flash memory and/or NVRAM memory, as discussed below. In one implementation, a computer program product is tangibly embodied in an information carrier. The computer program product contains instructions that, when executed, perform one or more methods, such as those described above. The information carrier is a computer- or machine-readable medium, such as the memory 664, expansion memory 674, or memory on processor 652, that may be received, for example, over transceiver 668 or external interface 662.

Device 650 may communicate wirelessly through communication interface 666, which may include digital signal processing circuitry where necessary. Communication interface 666 may provide for communications under various modes or protocols, such as GSM voice calls, SMS, EMS, or MMS messaging, CDMA, TDMA, PDC, WCDMA, CDMA2000, or GPRS, among others. Such communication may occur, for example, through radio-frequency transceiver 668. In addition, short-range communication may occur, such as using a Bluetooth, WiFi, or other such transceiver (not shown). In addition, GPS (Global Positioning System) receiver module 670 may provide additional navigation- and location-related wireless data to device 650, which may be used as appropriate by applications running on device 650.

Device 650 may also communicate audibly using audio codec 660, which may receive spoken information from a user and convert it to usable digital information. Audio codec 660 may likewise generate audible sound for a user, such as through a speaker, e.g., in a handset of device 650. Such sound may include sound from voice telephone calls, may include recorded sound (e.g., voice messages, music files, etc.) and may also include sound generated by applications operating on device 650.

The computing device 650 may be implemented in a number of different forms, as shown in the figure. For example, it may be implemented as a cellular telephone 680. It may also be implemented as part of a smart phone 682, personal digital assistant, or other similar mobile device.

While certain features of the described implementations have been illustrated as described herein, many modifications, substitutions, changes and equivalents will now occur to those skilled in the art. It is, therefore, to be understood that the appended claims are intended to cover all such modifications and changes as fall within the true spirit of the embodiments of the invention.

What is claimed is:

1. An electrical connector comprising:

a cord comprising a plurality of wires; and a plug extending from the cord, the plug including a top portion and an opposing bottom portion, each of the top portion and opposing bottom portion including a plurality of contacts, the plurality of contacts on each of the top portion and opposing bottom portion including:

at least three contacts with a first distance from a front portion of the plug; and at least one contact with a second distance from the front portion of the plug, each of the plurality of contacts on the top portion being coupled to one of the plurality of wires and to one of the plurality of contacts on the bottom portion, a first of the at least three contacts on the top portion with the first distance from the front portion of the plug being coupled to a first of the at least three contacts on the bottom portion with the first distance from the front portion of the plug and closer to a first side portion of the plug than a second and third of the at least three contacts on the top portion with the first distance, the first of the at least three contacts on the opposing bottom portion with the first distance from the front portion of the plug being closer to a second side portion of the plug than a second and third of the at least three contacts on the opposing bottom portion with the first distance.

2. The electrical connector of claim 1, wherein:

the third of the at least three contacts on the top portion with the first distance from the front portion of the plug is coupled to the third of the at least three contacts on the bottom portion with the first distance from the front portion of the plug and is closer to the second side portion of the plug than the first and second of the at least three contacts on the top portion with the first distance; and the third of the at least three contacts on the opposing bottom portion with the first distance from the front portion of the plug is closer to the first side portion of the plug than the first and second of the at least three contacts on the opposing bottom portion with the first distance from the front portion of the plug.

3. The electrical connector of claim 1, wherein:

the plurality of contacts on each of the top portion and opposing bottom portion includes at least one contact with a third distance from the front portion of the plug, the contact with the third distance from the front portion of the plug on the top portion is coupled to the contact with the third distance from the front portion of the plug on the opposing bottom portion, and the contact with the second distance from the front portion of the plug on the top portion is arranged in a column with the contact with the third distance from the front portion of the plug on the top portion, the column being longitudinal along an imaginary line in a direction in which the plug extends from the cord.

4. An electrical connector comprising:

a cord comprising a plurality of wires; and a plug extending from the cord, the plug including a top portion and an opposing bottom portion, each of the top portion and opposing bottom portion including a plurality of contacts, the plurality of contacts on each of the top portion and opposing bottom portion including:

at least two contacts with a first distance from a front portion of the plug;

at least one contact with a second distance from the front portion of the plug; and at least one contact with a third distance from the front portion of the plug, the contact with the third distance from the front portion of the plug on the top portion being coupled to the contact with the third distance from the front portion of the plug on the opposing bottom portion, the contact with the second distance from the front portion of the plug on the top portion being arranged in a column with the contact with the third distance from the front portion of the plug on the top portion, the column being longitudinal along an imaginary line in a direction in which the plug extends from the cord, each of the plurality of contacts on the top portion being coupled to one of the plurality of wires and to one of the plurality of contacts on the bottom portion.

5. The electrical connector of claim 1, wherein the plug includes a printed circuit board (PCB).

6. The electrical connector of claim 1, wherein the plug includes a Universal Serial Bus (USB) plug.

7. An electrical socket comprising:

a housing defining a recess and an opening of the socket; and a plurality of pins extending into the recess, each of the plurality of pins terminating at either a first distance from the opening, a second distance from the opening, or a third distance from the opening;

wherein the pins that terminate the first distance from the opening are coupled to one other pin of the plurality of pins, wherein the pins that terminate the second distance from the opening are not coupled to any other of the plurality of pins, and wherein the pins that terminate the third distance from the opening are not coupled to any other of the plurality of pins.

8. The electrical socket of claim 7, wherein the electrical socket includes a Universal Serial Bus (USB) socket.

9. The electrical socket of claim 7, wherein the first distance is less than the second distance and greater than the third distance.

10. The electrical socket of claim 7, wherein the pins that terminate the first distance from the opening are coupled to a pin on an opposite side of the recess.

11. The electrical socket of claim 7, wherein:

the pins that terminate at the second distance from the opening are electrically isolated from the other pins of the plurality of pins, and the pins that terminate at the third distance from the opening are electrically isolated from the other pins of the plurality of pins.

12. The electrical socket of claim 7, wherein the plurality of pins includes:

ten pins extending from a top of the housing into the recess and terminating the first distance from the opening;

one pin extending from the top of the housing into the recess and terminating the second distance from the opening;

ten pins extending from a bottom of the housing into the recess and terminating the first distance from the opening; and one pin extending from the bottom of the housing into the recess and terminating the third distance from the opening.

13. An electrical socket comprising:

a top portion above a recess of the electrical socket and a bottom portion below the recess of the electrical socket;

at least a first electrical node, a second electrical node, a third electrical node, and a fourth electrical node; and a least a first pin extending into the recess from the top portion, a second pin extending into the recess from the top portion, a third pin extending into the recess from the top portion, a fourth pin extending into the recess from the bottom portion, a fifth pin extending into the recess from the bottom portion, and a sixth pin extending into the recess from the bottom portion, wherein:

the first pin is coupled to the first electrical node;

the second pin is coupled to the second electrical node and is farther from a front of the socket than the fifth pin;

the third pin is coupled to the third electrical node;

the fourth pin is coupled to the first electrical node;

the fifth pin is coupled to the fourth electrical node and is closer to the front of the socket than the second pin; and the sixth pin is coupled to the third electrical node.

14. The electrical socket of claim 13, wherein:

the second pin is farther from the front of the socket than the first pin and the third pin; and the fifth pin is closer to the front of the socket than the fourth pin and the sixth pin.

15. The electrical socket of claim 14, wherein:

the first pin is closer to a first side portion of the electrical socket than the third pin; and the fourth pin is closer to a second side portion of the electrical socket than the sixth pin.

16. The electrical socket of claim 13, wherein:

the first pin is closer to a first side portion of the electrical socket than the third pin; and the fourth pin is closer to a second side portion of the electrical socket than the sixth pin.

17. The electrical connector of claim 4, wherein the plug includes a printed circuit board (PCB).

* * * * *

UNITED STATES PATENT AND TRADEMARK OFFICE

CERTIFICATE OF CORRECTION

PATENT NO. : 8,821,172 B1
APPLICATION NO. : 14/050035
DATED : September 2, 2014
INVENTOR(S) : Zhonghua Wu et al.

It is certified that error appears in the above-identified patent and that said Letters Patent is hereby corrected as shown below:

In the Claims

In column 22, line 27, in claim 13, delete "a least a" and insert -- at least a --, therefor.

Signed and Sealed this
Twenty-fifth Day of November, 2014

Michelle K. Lee

Michelle K. Lee
*Deputy Director of the United States Patent and Trademark Office*